US011319175B2

(12) United States Patent
Hayasaka

(10) Patent No.: US 11,319,175 B2
(45) Date of Patent: May 3, 2022

(54) SHEET FEEDING DEVICE, IMAGE FORMING APPARATUS INCORPORATING THE SHEET FEEDING DEVICE, AND IMAGE FORMING SYSTEM INCORPORATING THE SHEET FEEDING DEVICE

(71) Applicant: Kenji Hayasaka, Kanagawa (JP)

(72) Inventor: Kenji Hayasaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 236 days.

(21) Appl. No.: 16/584,043

(22) Filed: Sep. 26, 2019

(65) Prior Publication Data

US 2020/0102169 A1 Apr. 2, 2020

(30) Foreign Application Priority Data

Sep. 28, 2018 (JP) ..... JP2018-185719

(51) Int. Cl.

| | |
|---|---|
| ***B65H 3/48*** | (2006.01) |
| ***B65H 3/14*** | (2006.01) |
| ***B65H 5/22*** | (2006.01) |
| ***B65H 5/36*** | (2006.01) |
| ***B65H 3/68*** | (2006.01) |

(52) U.S. Cl.

CPC ..... *B65H 3/14* (2013.01); *B65H 3/48* (2013.01); *B65H 3/68* (2013.01); *B65H 5/224* (2013.01); *B65H 5/36* (2013.01)

(58) Field of Classification Search

CPC . B65H 3/12; B65H 3/128; B65H 3/48; B65H 3/5215; B65H 3/66; B65H 3/68

See application file for complete search history.

(56) References Cited

U.S. PATENT DOCUMENTS

| | | | | |
|---|---|---|---|---|
| 5,320,338 A * | 6/1994 | Shinohara | B65H 1/266 | 271/126 |
| 6,170,701 B1 * | 1/2001 | Youn | B65H 3/0653 | 221/126 |
| 8,814,159 B2 * | 8/2014 | Kadowaki | B65H 7/04 | 271/94 |

(Continued)

FOREIGN PATENT DOCUMENTS

| | | |
|---|---|---|
| JP | 2008-137763 | 6/2008 |
| JP | 2011-162321 | 8/2011 |

(Continued)

OTHER PUBLICATIONS

European Search Report dated Feb. 27, 2020 issued in corresponding European Application No. 19199910.1.

*Primary Examiner* — Howard J Sanders
(74) *Attorney, Agent, or Firm* — Harness, Dickey & Pierce, P.L.C.

(57) ABSTRACT

A sheet feeding device includes a sheet loader, a first conveyor, a second conveyor, and a guide. The sheet loader is configured to load a sheet bundle including a sheet with a flap. The first conveyor is configured to convey the sheet with the flap loaded on the sheet loader. The second conveyor is disposed adjacent to the first conveyor. The guide is disposed below the flap of the sheet to be conveyed, between the second conveyor and the sheet loader in a sheet conveying direction of the sheet, and is configured to guide the sheet.

18 Claims, 18 Drawing Sheets

(56) References Cited

U.S. PATENT DOCUMENTS

| | | | | |
|---|---|---|---|---|
| 9,022,379 | B2 * | 5/2015 | Takahashi | B65H 3/48 271/104 |
| 10,308,455 | B2 * | 6/2019 | Muramoto | B65H 3/64 |
| 11,198,572 | B2 * | 12/2021 | Tokoro | B65H 1/266 |
| 2005/0040584 | A1 * | 2/2005 | Isemura | B65H 3/48 271/97 |
| 2005/0133980 | A1 * | 6/2005 | Koga | B65H 3/0816 271/97 |
| 2011/0193285 | A1 | 8/2011 | Kadowaki | |
| 2013/0242359 | A1 | 9/2013 | Heishi et al. | |
| 2013/0320611 | A1 | 12/2013 | Kubo et al. | |
| 2015/0048566 | A1 | 2/2015 | Utagawa et al. | |
| 2016/0190329 | A1 | 6/2016 | Matsumoto et al. | |
| 2016/0229650 | A1 | 8/2016 | Iwamoto | |
| 2016/0267873 | A1 | 9/2016 | Saotome et al. | |
| 2016/0272443 | A1 | 9/2016 | Seto et al. | |
| 2017/0349390 | A1 * | 12/2017 | Nakamura | B65H 7/20 |
| 2020/0299081 | A1 * | 9/2020 | Waragai | G03G 15/6511 |
| 2021/0171301 | A1 * | 6/2021 | Hirai | B65H 3/06 |

FOREIGN PATENT DOCUMENTS

| | | |
|---|---|---|
| JP | 2015-046568 | 3/2015 |
| JP | 2015-111653 | 6/2015 |
| JP | 2016-029716 | 3/2016 |
| JP | 2016-079013 | 5/2016 |

* cited by examiner

VIEW a

VIEW b

VIEW A

VIEW B

SHEET FEEDING DEVICE, IMAGE FORMING APPARATUS INCORPORATING THE SHEET FEEDING DEVICE, AND IMAGE FORMING SYSTEM INCORPORATING THE SHEET FEEDING DEVICE

CROSS-REFERENCE TO RELATED APPLICATION

This patent application is based on and claims priority pursuant to 35 U.S.C. § 119(a) to Japanese Patent Application No. 2018-185719 filed on Sep. 28, 2018, in the Japan Patent Office, the entire disclosure of which is hereby incorporated by reference herein.

BACKGROUND

Technical Field

This disclosure relates to a sheet feeding device, an image forming apparatus incorporating the sheet feeding device, and an image forming system incorporating the sheet feeding device.

Discussion of the Background Art

Various types of sheet feeding devices are known to include a first conveyor that conveys one conveyance target body from a bundle of conveyance target bodies loaded on a loading unit, a second conveyor that is disposed next to the first conveyor, and space below a sheet conveyance passage between the loading unit and the second conveyor.

SUMMARY

At least one aspect of this disclosure provides a sheet feeding device including a sheet loader, a first conveyor, a second conveyor, and a guide. The sheet loader is configured to load a sheet bundle including a sheet with a flap. The first conveyor is configured to convey the sheet with the flap loaded on the sheet loader. The second conveyor is disposed adjacent to the first conveyor. The guide is disposed below the flap of the sheet to be conveyed, between the second conveyor and the sheet loader in a sheet conveying direction of the sheet. The guide is configured to guide the sheet.

Further, at least one aspect of this disclosure provides an image forming apparatus including an image forming device configured to form an image on a sheet, and the above-described sheet feeding device configured to feed the sheet toward the image forming device.

Further, at least one aspect of this disclosure provides an image forming system including an image forming apparatus configured to form an image at least on a sheet and the above-described sheet feeding device configured to feed the sheet toward the image forming apparatus.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
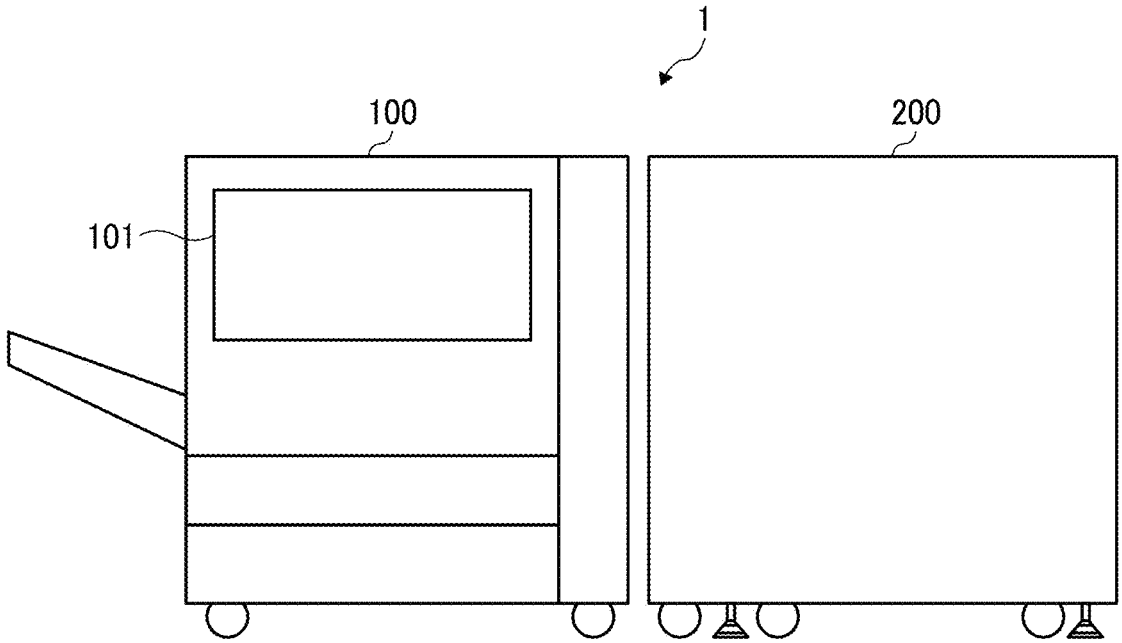
FIG. 1 is a diagram illustrating a schematic configuration of an image forming system including a sheet feeding device according to an embodiment of this disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout.

As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of a sheet feeding device, an image forming apparatus, and an image forming system according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any sheet feeding device, image forming apparatus, and image forming system, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, embodiments of the present disclosure are described below. In the drawings for explaining the following embodiments, the same reference codes are allocated to elements (members or components) having the same function or shape and redundant descriptions thereof are omitted below.

A description is given of a sheet feeding device according to an embodiment of this disclosure.

FIG. 1 is a diagram illustrating a schematic configuration of an image forming system 1 including a sheet feeding device according to the present embodiment of this disclosure.

As illustrated in FIG. 1, the image forming system 1 includes an image forming apparatus 100 that includes an image forming device 101 to form an image on a sheet, and a sheet feeding device 200 to feed the sheet to the image forming apparatus 100. The sheet feeding device 200 is disposed at a side face of an apparatus body of the image forming apparatus 100.

The sheet feeding device 200 is disposed at a side face of an apparatus body of the image forming apparatus 100.

The recording method of the image forming apparatus 100 to which the sheet feeding device 200 according to the present embodiment is applied is not particularly limited, and any method such as an electrophotographic method or an inkjet method is adopted. A sheet entrance is provided on the right side of the apparatus body of the image forming apparatus 100 in FIG. 1. A sheet conveyed from the sheet feeding device 200 comes into the apparatus body of the image forming apparatus 100 through the sheet entrance. At the sheet entrance, an opening and a sheet conveying unit are provided. The sheet is received through the opening and then is conveyed by the sheet conveyor.

Figure 2:
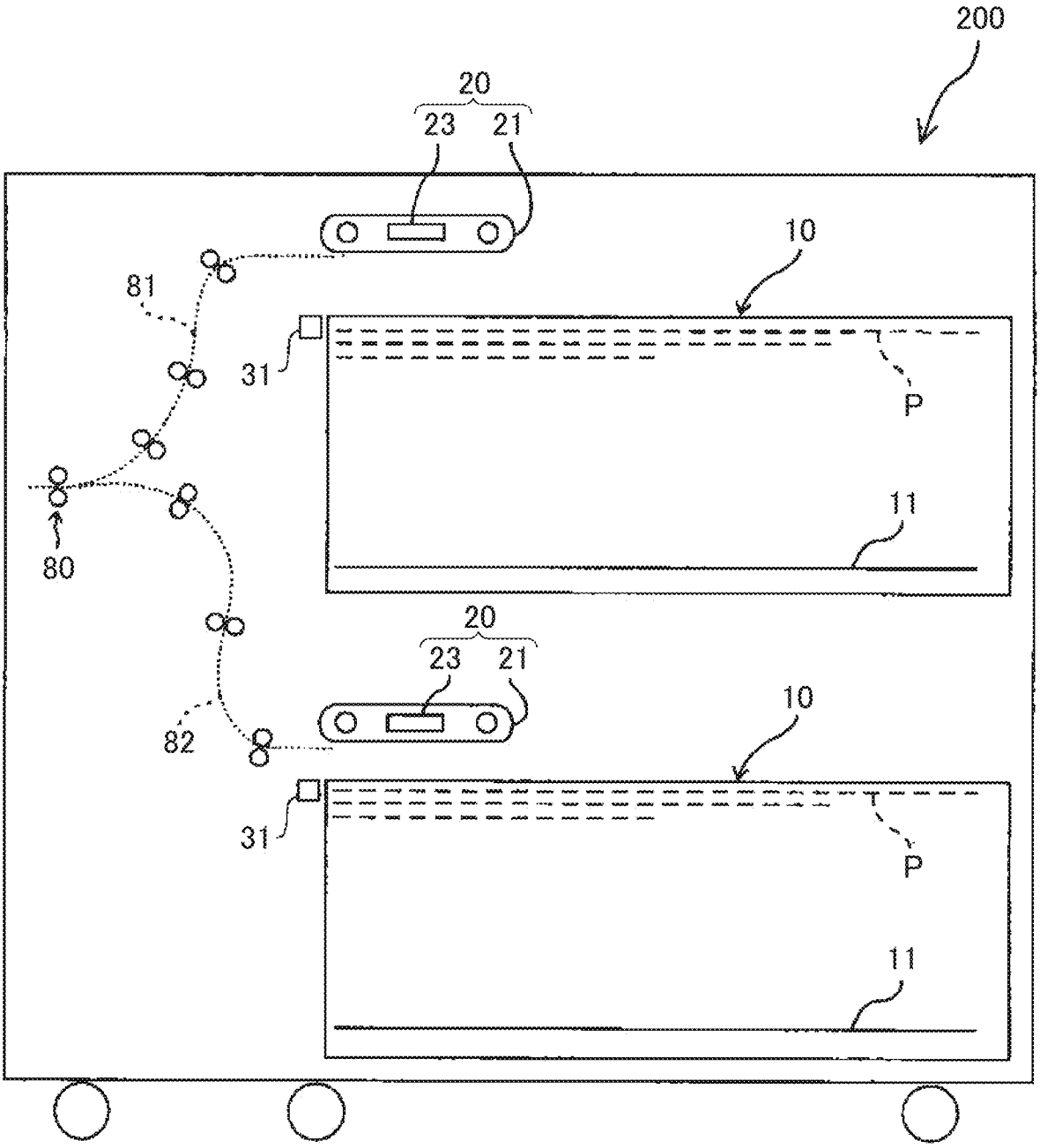
FIG. 2 is a schematic diagram illustrating the sheet feeding device according to the present embodiment of this disclosure.

FIG. 2 is a schematic diagram illustrating the sheet feeding device 200 according to the present embodiment of this disclosure, which is disposed on a side face of the apparatus body of the image forming apparatus 100.

As illustrated in FIG. 2, the sheet feeding device 200 includes two-stage, upper and lower, sheet trays 10. Each of the sheet trays 10 includes a sheet loading table 11 that functions as a sheet loader on which a sheet bundle P is loaded. In the present embodiment, each of the sheet trays 10 is capable of containing up to about 2500 sheets.

The term "sheet" includes plain paper, coated paper, label paper, OHP sheet, film, and prepreg. Prepregs are mainly used as materials for laminates and multilayer printed wiring boards. For example, the prepreg includes a sheet-like material that is manufactured by, for example, continuously impregnating a resin varnish mainly formed by a thermosetting resin such as epoxy resin and polyimide resin, into an elongated base such as glass cloth, paper, non-woven cloth, and aramid cloth, then heating, drying, and cutting. The sheet includes an envelope or bag-like medium provided with a flap for closing the mouth of the envelope or bag-like medium.

A sheet feeding unit 20 is disposed above the corresponding sheet tray 10. The sheet feeding unit 20 separates and feeds a sheet loaded on the sheet tray 10. The sheet feeding unit 20 includes an attraction belt 21 that functions as a first conveyor and a sheet conveying body, and an upward air suction device 23.

Each sheet loaded on the lower sheet tray 10 passes through a lower conveyance passage 82 to be conveyed by the pair of ejection rollers 80 to the apparatus body of the image forming apparatus 100. Similarly, each sheet loaded on the upper sheet tray 10 passes through an upper conveyance passage 81 to be conveyed by the pair of ejection rollers 80 to the apparatus body of the image forming apparatus 100.

Figure 3:
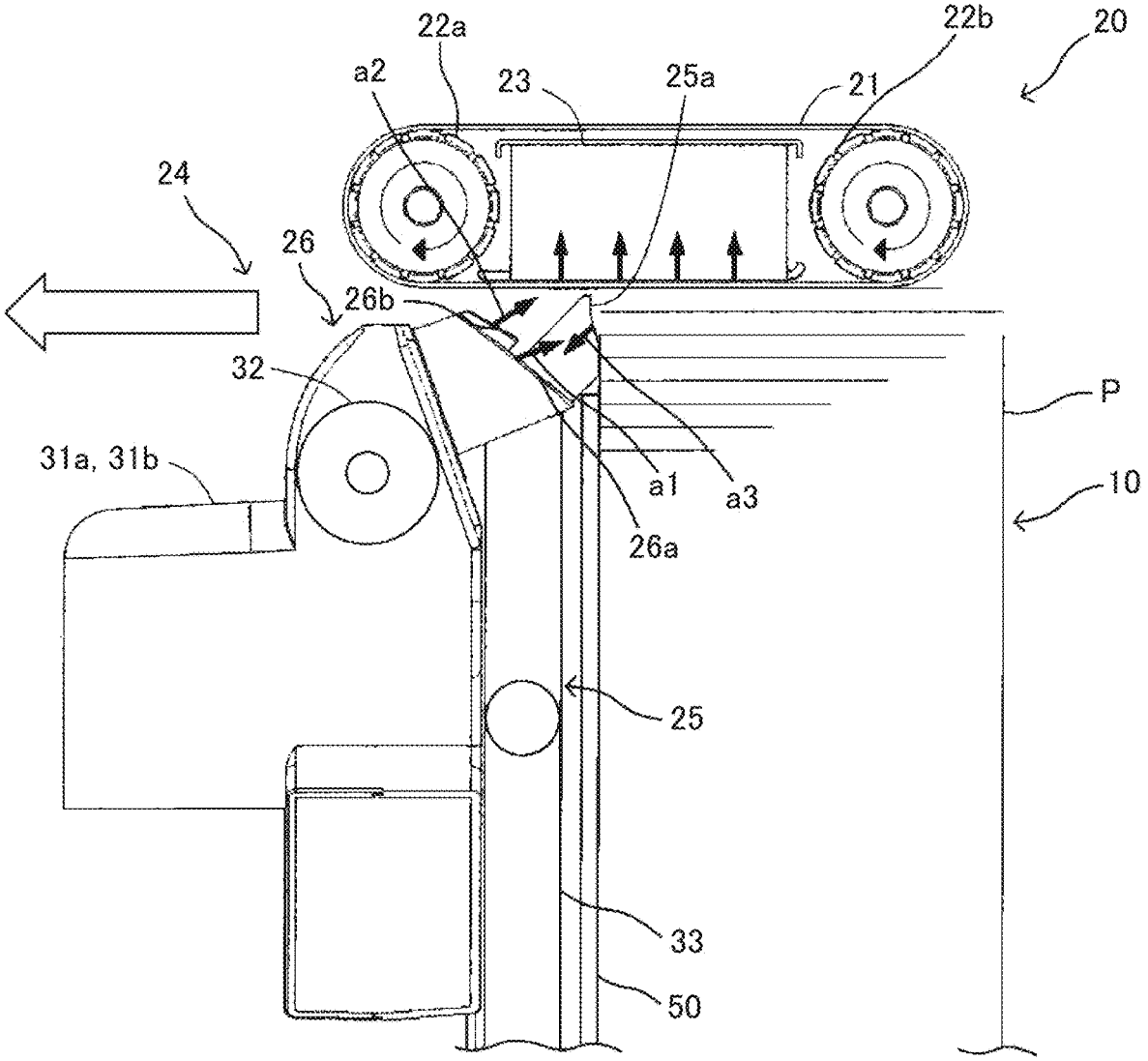
FIG. 3 is a schematic side view illustrating the sheet feeding device.
Figure 4:
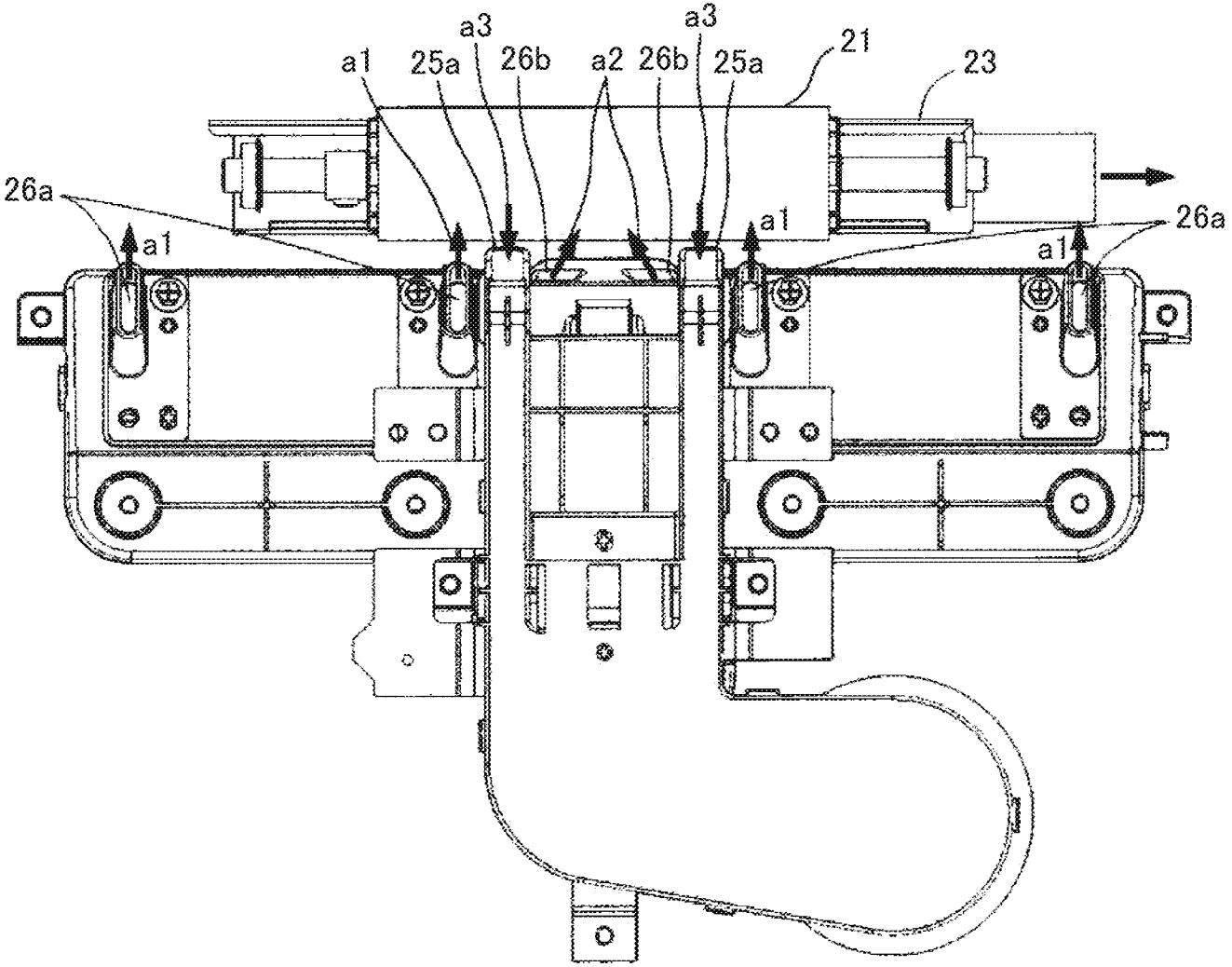
FIG. 4 is a schematic front view illustrating the sheet feeding device.
Figure 5:
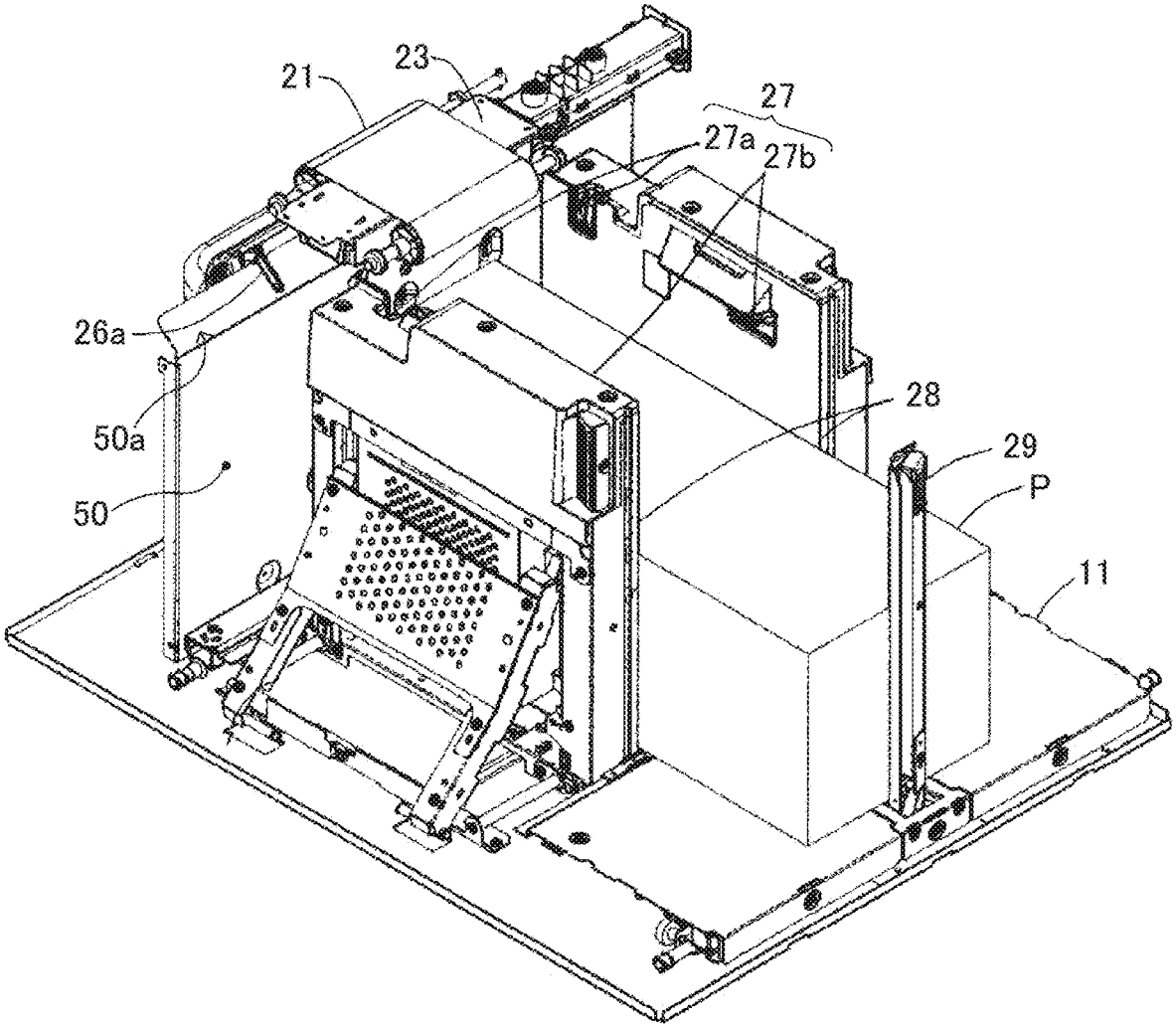
FIG. 5 is a schematic perspective view illustrating the sheet feeding device.
Figure 6:
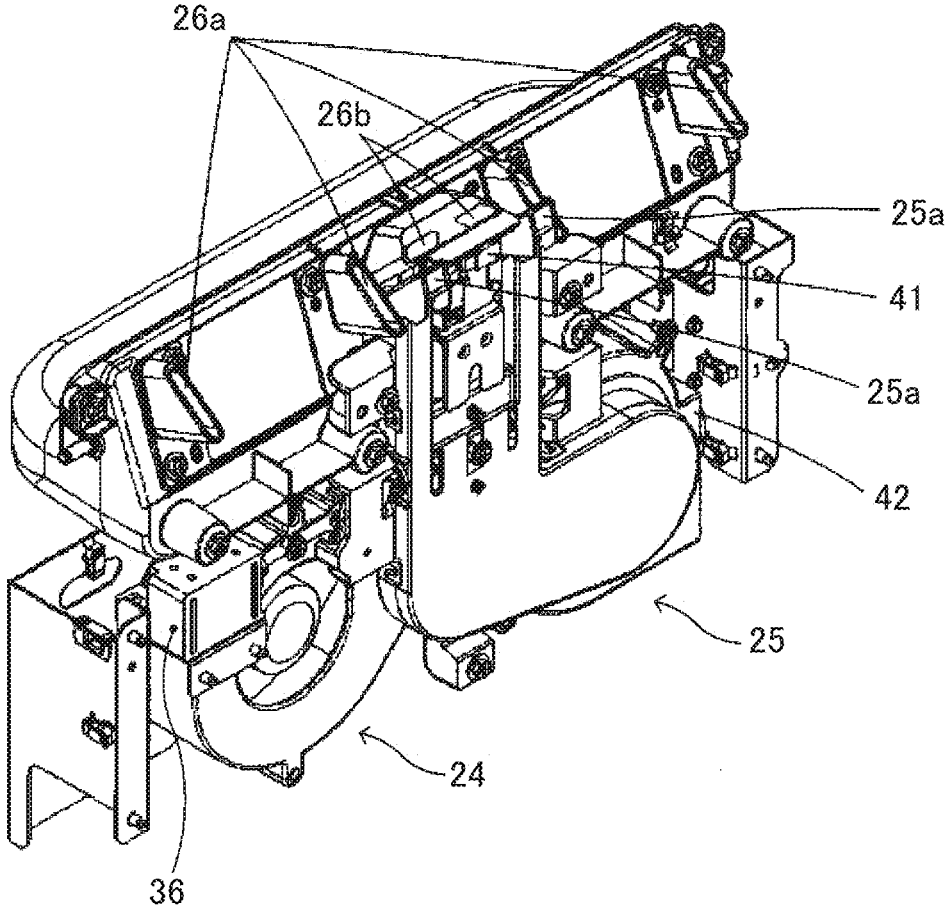
FIG. 6 is a schematic perspective view illustrating an air blowing device and a downward air suction device.
Figure 7:
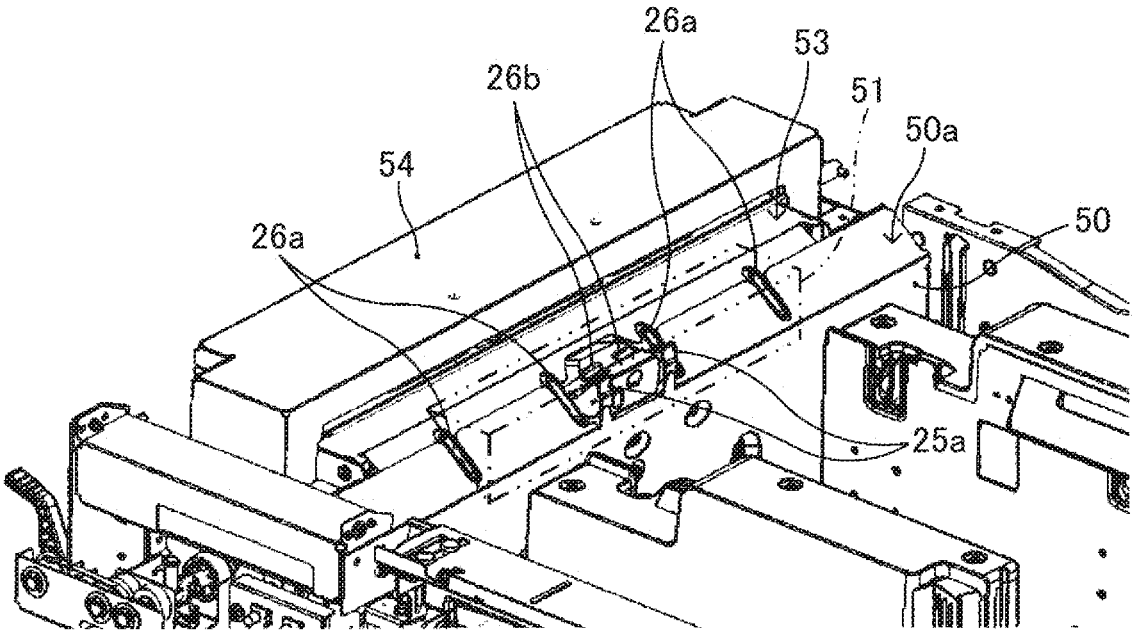
FIG. 7 is a schematic perspective view illustrating a front-end portion of the sheet feeding device.
Figure 8:
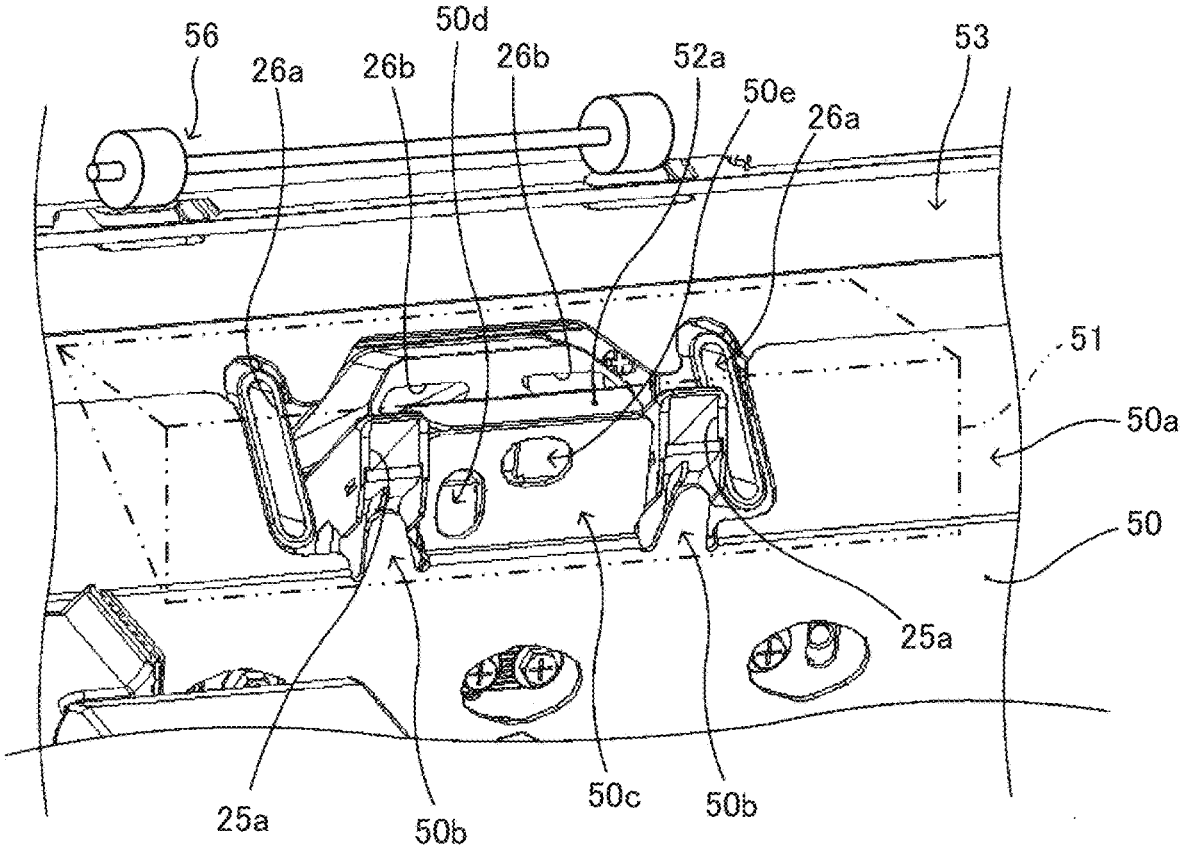
FIG. 8 is an enlarged view illustrating the front-end portion of the sheet feeding device.

FIG. 3 is a schematic side view illustrating the sheet feeding device 200 according to the present embodiment. FIG. 4 is a schematic front view illustrating the sheet feeding device 200 according to the present embodiment. FIG. 5 is a schematic perspective view illustrating the sheet feeding device 200 according to the present embodiment. FIG. 6 is a schematic perspective view illustrating an air blowing device and a downward air suction device. FIG. 7 is a schematic perspective view illustrating a front-end portion of the sheet feeding device 200 according to the present embodiment. FIG. 8 is an enlarged view illustrating the front-end portion of the sheet feeding device 200 according to the present embodiment.

As illustrated in FIG. 3, the attraction belt 21 of the sheet feeding unit 20 that functions as a first sheet feeder is stretched over two tension rollers 22*a* and 22*b*. The attraction belt 21 includes suction holes in the entire region in the circumferential direction of the attraction belt 21. The suction holes penetrate through the front face side to the back face side of the attraction belt 21. The upward air suction device 23 is disposed within an inner loop of the attraction belt 21. The upward air suction device 23 is connected to an upward suction fan that functions as an air suction fan to intake air via the air duct that functions as an air flowing passage. As the upward air suction device 23 generates a negative pressure in a downward direction, the sheet P is attracted to a lower face of the attraction belt 21.

Further, each of the upper sheet tray 10 and the lower sheet tray 10 includes an air blowing device 24 and a downward air suction device 25. The air blowing device 24 functions as an air blowing device to blow air to the upper sheets of the sheet bundle P. The downward air suction device 25 functions as an air suction device to draw (intake) air near the upper sheets of the sheet bundle P.

The air blowing device 24 that functions as an air blower includes a front air blowing device 26 and side air blowing devices 27. As illustrated in FIGS. 3 and 4, the front air blowing device 26 to blow air to a leading end (a downstream end in a sheet conveying direction indicated by a white arrow in FIG. 3) of the sheet bundle P. The front air blowing device 26 includes a floating nozzle 26*a* and a separation nozzle 26*b*. The floating nozzle 26*a* blows air in a direction to float the upper sheets of the sheet bundle P. The separation nozzle 26*b* blows air to the attraction belt 21 and causes the air to reflect the attraction belt 21 so that other sheets except for an uppermost sheet as a first sheet of the sheet bundle P are directed downward and separated from the uppermost sheet. The air blowing device 24 includes a floating air chamber 31*a* communicating with the floating nozzle 26*a* and a separation air chamber 31*b* communicating with the separation nozzle 26*b*. A float-and-separation shutter 32 is disposed inside the floating air chamber 31*a* and the separation air chamber 31*b* to instantaneously block and release the ventilation in the floating air chamber 31*a* and the separation air chamber 31*b*.

Blowing fans are disposed in the floating air chamber 31*a* and the separation air chamber 31*b*, respectively, to send air. The air blown from the floating nozzle 26*a* in a direction indicated by arrow a1 in FIG. 4 is referred to as front floating air and the air blown from the separation nozzle 26*b* in a direction indicated by arrow a2 is referred to as separation air. The front floating air and the separation air are discharged from respective portions facing the leading end of the upper sheets of the sheet bundle P (i.e., the downstream side end in the sheet conveying direction). Consequently, the floating air and the separation air are blown to the leading end of the upper sheets of the sheet bundle P (i.e., the downstream side end in the sheet conveying direction).

Further, as illustrated in FIG. 5, the side air blowing devices 27 are disposed in a pair of side fences 28 that positions to maintain the sheets in a state of not skewing in a width direction corresponding to a direction perpendicular to the sheet conveying direction. The sheet feeding device 200 employs center reference for moving both of the two side fences 28 in the width direction according to the sheet size. That is, the side fences 28 regulate the sheet position so that the sheet P is set at the center in the width direction of the sheet P. Each of the side air blowing devices 27 is mounted on a corresponding one of the side fences 28 so that the side air blowing devices 27 blow air to the end portions in a width direction of the upper part of the sheet bundle P to flip and separate the upper sheets of the sheet bundle P.

Each of the side air blowing devices 27 includes side floating nozzle front portions 27*a* and side floating nozzle rear portions 27*b*. The side floating nozzle front portions 27*a* are arranged to face front sides of lateral sides of the sheet in the sheet conveying direction and guide air in a direction to separate and float the sheet bundle P. The side floating nozzle rear portions 27*b* are arranged to face rear sides of the lateral sides of the sheet in the sheet conveying direction. Air blown from the side floating nozzle front portions 27*a* and the side floating nozzle rear portions 27*b* is referred to as side floating air. The side floating air is discharged from an air discharging port provided to a portion that faces the upper part of the sheet bundle P of each of the side fences 28 and is blown to the side face of the upper part of the sheet bundle P. The air blown from the floating nozzle 26*a* and the separation nozzle 26*b* of the front air blowing device 26 and the side floating nozzle front portion 27*a* and the side floating nozzle rear portion 27*b* of the side air blowing devices 27 lifts the sheets of the upper part of the sheet bundle P. Further, as illustrated in FIG. 5, the sheet tray 10 is provided with an end fence 29 to align the rear end of the sheet bundle P stacked on the sheet loading table 11.

As illustrated in FIGS. 3, 4, and 6, the downward air suction device 25 that functions as an air sucker intakes air around the leading end of the sheets of the upper part of the sheet bundle P toward the lower portion to generate negative pressure to apply force in a direction to move away from the attraction belt 21. The downward air suction device 25 includes a downward air suction nozzle 25*a* and a downward air suction chamber 33. The downward air suction nozzle 25*a* suctions air around the leading end of the sheets of the upper part of the sheet bundle P in a direction indicated by arrow a3 in FIGS. 3 and 4. The downward air suction chamber 33 communicates with the downward air suction nozzle 25*a*. The downward air suction chamber 33 includes a downward air suction fan 42 that functions as an air drawing unit to intake air. Further, inside the downward air suction chamber 33, a downward air suction shutter is provided to function as an opening and closing mechanism to instantly switch shutting and opening of air flow inside the downward air suction chamber 33.

As illustrated in FIG. 6, the sheet feeding device 200 includes a sheet top sensor 41 that is a sheet height detector to detect the height of an upper face of the uppermost sheet of the sheet bundle P. The sheet top sensor 41 is disposed upstream from the attraction belt 21 in a sheet conveying direction.

In the sheet feeding device 200, the distance between the upper face of the uppermost sheet of the sheet bundle P in the sheet tray, in which the number of sheets decreases with sheet feeding, and the lower face of the attraction belt 21 is kept within a certain range. Hence, the sheet feeding device 200 detects the height of the upper face of the uppermost sheet with the sheet top sensor 41, and controls, based on a detection signal of the sheet top sensor 41, a bottom-plate lift motor as a drive source of a lift to vertically move the bottom plate of the sheet tray. Such a configuration can control the height of the bottom plate so that the distance between the upper face of the uppermost sheet of the sheet bundle P placed on the bottom plate and the bottom face of the attraction belt 21 falls within a certain range.

Further, the accuracy of the stop position in the height direction of the sheet loading table 11 detected by the sheet top sensor 41 is enhanced for the following reason (see FIG. 6). That is, the detection of the stop position at the time of raising and lowering the sheet loading table 11 is performed with the upper face of the sheet and the sheet top sensor 41. When air is brought between sheets and the sheets are floating, accurate detection of the upper face may not be performed. In order to address this inconvenience, the front floating air and the separation air are blocked with the shutter to drop the sheets, thus allowing accurate detection of the upper face of the uppermost sheet of the sheet bundle P. Instead of the upstream side of the attraction belt 21 in the sheet conveying direction, the sheet top sensor 41 may be disposed on a lateral side of the attraction belt 21 orthogonal to the sheet feed direction. Alternatively, a plurality of sheet top sensors 41 may be disposed on lateral sides of the attraction belt 21 orthogonal to the sheet conveying direction.

The downward air suction device 25 includes a downward air suction nozzle 25*a* that draws air around the leading end of the sheets of the upper part of the sheet bundle P so that a negative pressure generated by the downward air suction fan 42 is applied to the area around the leading end of the sheets of the upper part of the sheet bundle P. Two of the downward air suction nozzles 25*a* are arranged between the floating nozzle 26*a* and the separation nozzle 26*b*.

Further, the projecting end of the downward air suction nozzle 25*a* is disposed to suck the uppermost sheet of the sheet bundle P at a position close to the uppermost sheet in the height direction. Accordingly, it is more effective to reduce the gap between the downward air suction nozzle 25*a* and the attraction belt 21 since the separation effect is enhanced when the downward air suction nozzles 25*a* suck the uppermost sheet at positions closer to the uppermost sheet of the sheet bundle P. However, since a gap through which the uppermost sheet of the sheet bundle P can pass is also provided, the gap is preferably about 1 mm to about 3 mm. The gap is adjusted by the height of the downward air suction nozzle 25*a* with a mounting screw as adjuster. In addition, since the side faces and the upper face of the projecting end of the downward air suction nozzle 25*a* contacts a sheet, which may be worn and deteriorate. Hence, surface treatment or processing, such as metal plating, to reduce abrasion may be performed on the side faces and the upper face of the projecting end of the downward air suction nozzle 25*a*, thus allowing extension of the product life.

In the suction with the downward air suction nozzles 25*a*, a solenoid 36 reciprocally moves a pulling shaft in directions, thus switching opening and shutting of the downward air suction shutter. The downward air suction shutter is coupled to the solenoid 36 via the pulling shaft. A controller 60 controls turn-on and -off of the solenoid 36 to switch shutting-off and opening of suction air in the downward air suction chamber 33.

The floating nozzle 26*a* and the separation nozzle 26*b* of the front air blowing device 26 and the downward air suction nozzle 25*a* of the downward air suction device 25 perform air blowing and suction from a notch formed in an inclined plate portion 50*a* which is inclined and extended so as to move up from the upper end of a front-alignment fence 50, which functions as an aligner to align the trailing end of the sheet bundle P loaded on the sheet loading table 11 toward the downstream side of the sheet conveying direction, as illustrated in FIG. 7. A space 51 is defined by the upper face of the inclined plate portion 50*a* and the conveyance passage surface located above the inclined plate portion 50*a*, as indicated by a broken line in FIG. 7. It is to be noted that the sheet feeding unit 20 is removed in FIG. 7. A cover 54 covers the conveyance unit that receives and further conveys a sheet that is fed from the sheet feeding unit 20 and guided by an upper face 53 that is substantially horizontal. In FIG. 7, the broken lines depicts the space 51 in a partial range corresponding to the width (i.e., the lateral distance) between the side fences 28.

In the space 51 above the inclined plate portion 50*a*, as illustrated in FIG. 8 which is an enlarged view of FIG. 7, the leading end of the downward air suction nozzle 25*a* extends through the notches formed in the inclined plate portion 50*a*. A pair of sheet blocking portions 50*b* and a sensor cover plate 50*c* stand vertically from the upper end of the front-alignment fence 50. A light transmission hole 50*d* of the sheet top sensor 41 and a light transmission hole 50*e* for a detection sensor of the sheet loading table 11 are formed in the sensor cover plate 50*c*. A sensor holder 52*a* that holds the sheet top sensors 41 also stands up. It is to be noted that the cover 54 is removed in FIG. 8, and a sheet conveying roller 56 that functions as a second conveyor is exposed.

The space 51 below the sheet conveyance passage illustrated in FIGS. 7 and 8 is inevitably generated in a case in which the inclined plate portion 50*a* is disposed to pick up a downwardly curled portion of the sheet and an end portion of the sheet that is located outside in the width direction of the attraction belt 21 of the sheet feeding unit 20 and is downwardly inclined due to the weight of the sheet and guide the downwardly curled portion of the sheet and the end portion of the sheet to the sheet conveyance passage located on the downstream side of the sheet conveying direction. However, the configuration having the space 51 may cause inconvenience described below.

A detailed description is given of the above-described configuration having the space 51.

Figure 9A:
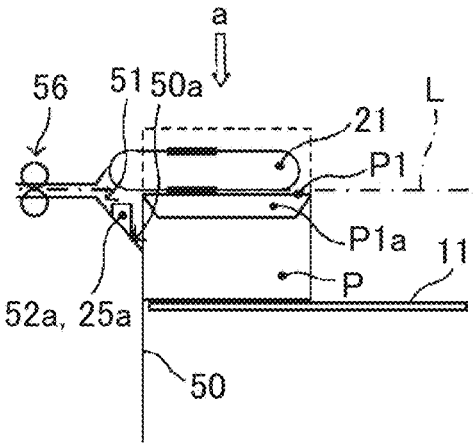
FIGS. 9A-9F are schematic diagrams of the sheet feeding device.
Figure 9B:
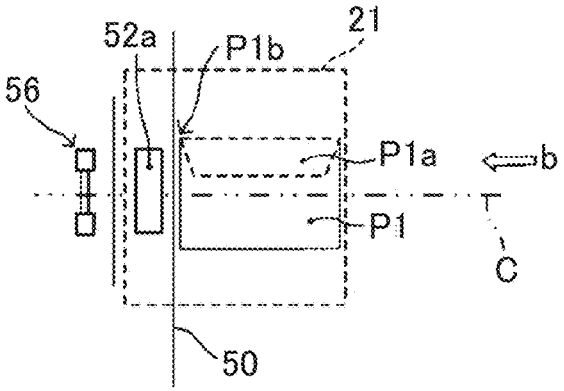
Figure 9C:
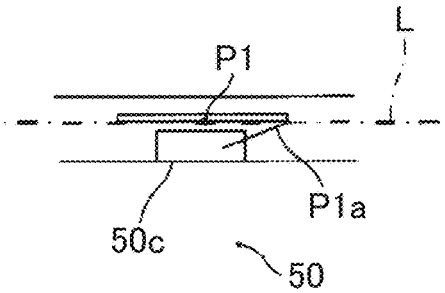
Figure 9D:
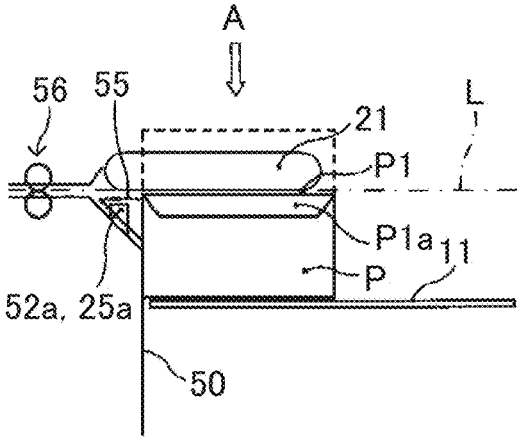
Figure 9E:
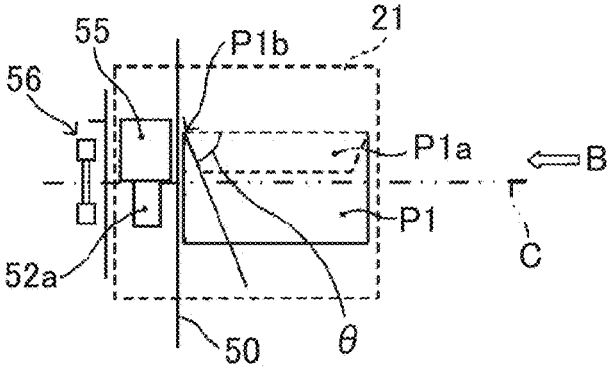
Figure 9F:
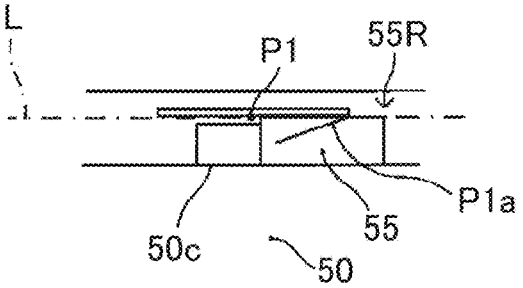

FIGS. 9A-9F are schematic diagrams of the sheet feeding device 200. FIG. 9A is a front view illustrating the sheet feeding device 200, FIG. 9B is a plan view (VIEW a) illustrating the sheet feeding device 200, viewed on arrow "a" in FIG. 9A, and FIG. 9C is a side view (VIEW b) illustrating the right side of the sheet feeding device 200, viewed on arrow "b" in FIG. 9B. Similarly, FIG. 9D is a front view illustrating the sheet feeding device 200, FIG. 9E is a plan view (VIEW A) illustrating the sheet feeding device 200, viewed on arrow "A" in FIG. 9D, and FIG. 9F is a side view (VIEW B) illustrating the right side of the sheet feeding device 200, viewed on arrow "B" in FIG. 9E.

In FIGS. 9A to 9C, the flap P1*a* of the envelope P1 is folded, the envelope P1 is placed on the sheet loading table 11 with the fold line direction of the envelope P1 being parallel to the sheet conveying direction and the flap P1*a* facing downwardly, and the envelope P1 is fed by the attraction belt 21. In FIG. 9A, an outline that would be visible when the flap P1*a* of the envelope P1 is opened is illustrated to be slightly downward to emphasize the flap P1*a* that is not actually be seen. A space 51 lies between a sheet conveyance passage L along the lower face of the attraction belt 21 and the upper face of the inclined plate portion 50*a*. The sheet conveyance passage L on the inclined plate portion 50*a* reaches the sheet conveying roller 56.

In a case in which the flap Pla is folded downward, when the envelope P1 is further fed from the state in which the front end of the envelope P1 having the folding origin P1*b* of the flap P1*a* is beyond the front-alignment fence 50, as illustrated in FIG. 9B, the flap P1*a* gradually enters the space 51. Consequently, the flap P1*a* that has entered the space 51 may drop by the own weight of the flap P1*a*. FIG. 9C illustrates the state in which the flap P1*a* has been lowered. In addition, in the present embodiment, since air is blown or sucked from the floating nozzle 26*a*, the separation nozzle 26*b*, and the downward air suction nozzle 25*a* in this space, the flap P1*a* may be lowered downward due to the airflow.

If the flap P1*a* is lowered in the space 51, the flap P1*a* may contact the upper face of the inclined plate portion 50*a*, resulting in paper jam. It is likely that envelopes and media are damaged or broken. In particular, in the present embodiment, the tip of the downward air suction nozzle 25*a*, the sensor holder 52*a*, and the sensor cover plate 50*c* are extended into the space 51. Accordingly, the flap P1*a* that has been lowered comes into contact with the tip of the downward air suction nozzle 25*a*, the sensor holder 52*a*, and the sensor cover plate 50*c*, which is likely to generate paper jam easily.

In order to address this inconvenience, it is conceivable to load the envelopes and media onto the sheet loading table 11 with the flaps of the envelopes and media being open, or to open the folded flaps of the sheets before the envelopes are loaded on the sheet loading table 11 and close the open flaps of the envelopes after the printing job performed by the image forming apparatus. However, these operations are not efficient in work efficiency and low in productivity. It has been found that, even when the envelopes are loaded with the flaps P1*a* facing down, if the envelopes are loaded on the sheet loading table 11 while the folding line is in a posture orthogonal to the sheet conveying direction, clogging due to the lowering of the flap P1*a* is relatively less likely to occur. However, in a case in which the length of the side of the envelope in the sheet conveying direction with this posture is less than the length of a conveyable envelope or medium in the sheet conveying direction in the image forming apparatus 100 or the sheet feeding device 200, the envelope is not conveyed in such a posture.

For example, in a case of the sheet feeding device 200 according to the present embodiment, even though a sheet having a length of less than 148 mm in the sheet conveying direction is not conveyable, there is a demand for printing on a rectangular envelope or medium having a short side of 130 mm and a long side of 180 mm to 200 mm, with a flap P1*a* to be folded at a folding line along the long side, as illustrated in FIG. 9B.

As the short side of the envelope or medium is shorter, the flap P1*a* of the envelope or medium is closer to the center of the short side and, as illustrated in FIG. 9B, the flap P1*a* easily contacts the downward air suction nozzle 25*a*, the sensor holder 52*a*, and the sensor cover plate 50*c*, disposed and concentrated in the vicinity of a line C that is a center reference in the sheet feeding device employing the center reference.

Therefore, in the present embodiment, a guide 55 is provided in order to address the above-described inconveniences. As described above, FIG. 9D is a front view illustrating the sheet feeding device 200 with the guide 55, FIG. 9E is a plan view (VIEW A) illustrating the sheet feeding device 200, viewed on arrow "A" in FIG. 9D, and FIG. 9F is a side view (VIEW B) illustrating the right side of the sheet feeding device 200, viewed on arrow "B" in FIG. 9E. As schematically illustrated in FIGS. 9D, 9E, and 9F, the upper face of the guide 55 faces a part within the width of the sheet conveyance passage L located above the space 51. In other words, as illustrated in FIG. 9D, the upper face of the guide 55 is located opposing the sheet conveyance passage L located above the space 51. As illustrated in FIG. 9E, the upper face of the guide 55 faces not the entire width direction but a part in the width direction within the width of the sheet conveyance passage L. The lower face of the flap P1*a* is supported and guided by the upper face of the guide 55. According to this configuration, the flap P1*a* is prevented from falling in the space 51 as illustrated in FIG. 9F. The flap P1*a* may be supported by the guide 55 over the entire area or in a part of the area. It is preferable to include an area near the fold. When an envelope as a sheet or a conveyance target object is set, the side fence regulates the position of the envelope so that the flap of the envelope comes to a position to be guided by the guide 55. It is also to be noted that the sheet conveying roller 56 is disposed adjacent to the attraction belt 21.

In order to prevent the lowering of the flap P1*a*, it is desirable that a width direction end 55R of the guide face illustrated in FIG. 9F is located outside the folding line of the flap P1*a* (i.e., the side on the folding line of the envelope P1). If the width direction end 55R is located halfway in the width direction of the flap P1*a*, it is likely that paper jam occurs when the portion close to the folding line of the flap P1*a*, at which the lower face of the flap P1*a* is not supported, moves downward to contact the upper face of the inclined plate portion 50*a* or the tip end of the downward air suction nozzle 25*a*. If air flow is generated due to air from each nozzle, the air flow may enter the gap between the flap P1*a* with the lower face being not supported and the body of the envelope, which may result in opening of the flap.

Since the lower face of the attraction belt 21 that functions as an opposing body is disposed facing the upper face of the guide 55, the following effect is achieved. Specifically, by sandwiching the flap P1*a* between the upper face of the guide 55 and the lower face of the attraction belt 21, the fold of the flap P1*a* is strengthened and the flap P1*a* is made more difficult to lower. Once the folding is strengthened, the envelope or medium maintains the posture without the support by the upper face of the guide 55 in the entire region of the space 51 in the sheet conveying direction. Strengthening the folding is sufficient in a closed state to a degree in which an envelope or medium is conveyable, and includes a case in which the envelope or medium returns to an open and closed state before the guide 55 is provided when the guide 55 is not supporting the envelope or medium.

It is desirable that the upper face of the guide 55 and the lower face of the opposing body (i.e., the attraction belt 21) are disposed in parallel to a direction orthogonal to the sheet conveying direction in order to strengthen the fold by the opposing body (i.e., the attraction belt 21) and the upper end portion of the guide 55 as described above. In addition, it is effective that the width direction end 55R of the guide face of the guide 55 is located outside the folding line of the flap P1*a* (i.e., the side on the folding line of the envelope P1) in order to strengthen the folding preferably. The tip edge of the flap P1*a* is inclined so as to be closer to the upstream side of the sheet conveying direction toward the center of the width direction center at an angle θ, as illustrated in FIG. 9E with the auxiliary line. Therefore, an increase in fold strengthening by sandwiching by the upper face of the guide 55 and the lower face of the opposing body (i.e., the attraction belt 21) is started from a start point P1*b* at which there is little risk of opening the flap P1*a*. Therefore, while making the flap P1*a* difficult to open by the fold strengthening, the sandwiching of an envelope or medium is processed toward the center of the width direction in which the flap P1*a* is highly likely to open sequentially. Furthermore, it is preferable that the upper face of the guide 55 has a convex curved face to reduce the load applied to the flap.

Different from this configuration, in a case in which the tip edge of the flap P1*a* is orthogonal to the sheet conveying direction, it is highly likely that, when entering the gap between the upper face of the guide 55 and the lower face of the opposing body (i.e., the attraction belt 21), a portion at the center in the width direction, which is relatively easy to open in the tip edge, collides with the guide 55 first, and the flap is deformed so as to open in the portion.

Figure 10:
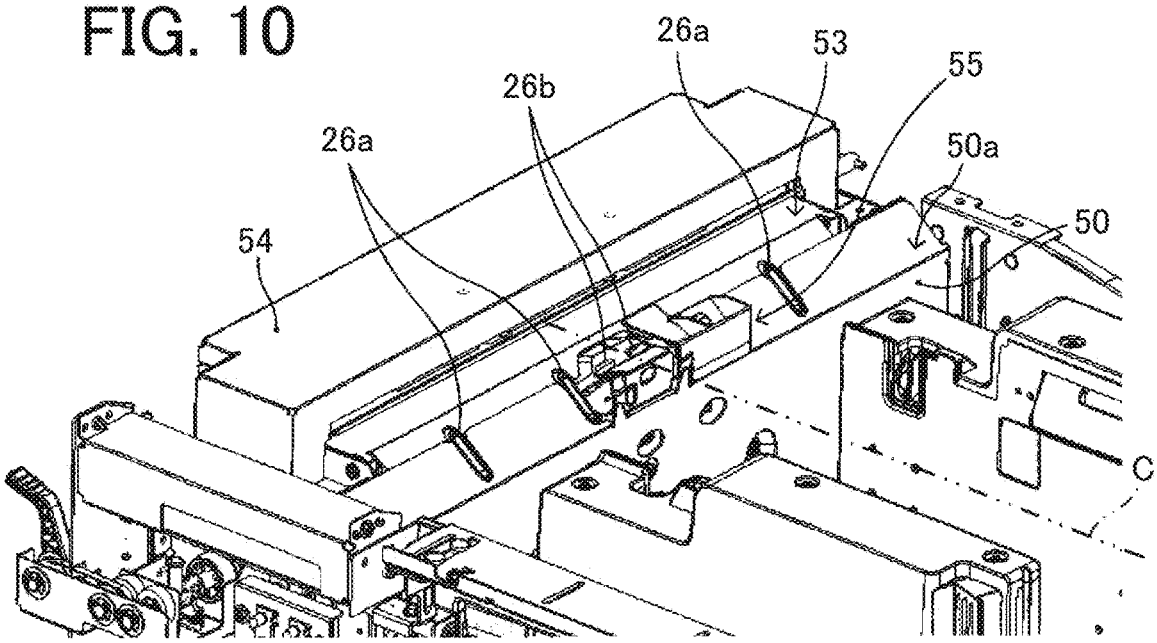
FIG. 10 is a schematic perspective view illustrating the front-end portion of the sheet feeding device employing a guide according to an example of this disclosure.
Figure 11:
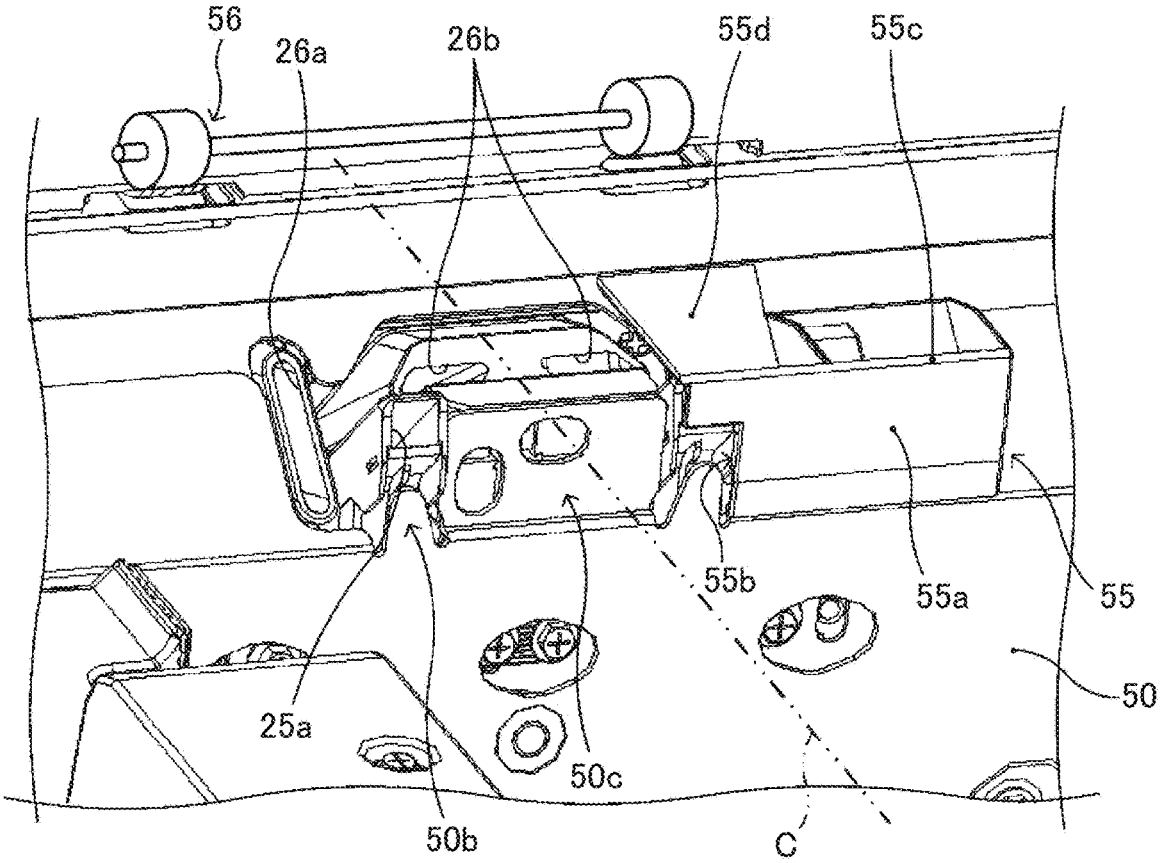
FIG. 11 is an enlarged view illustrating the front-end portion of the sheet feeding device.
Figure 12:
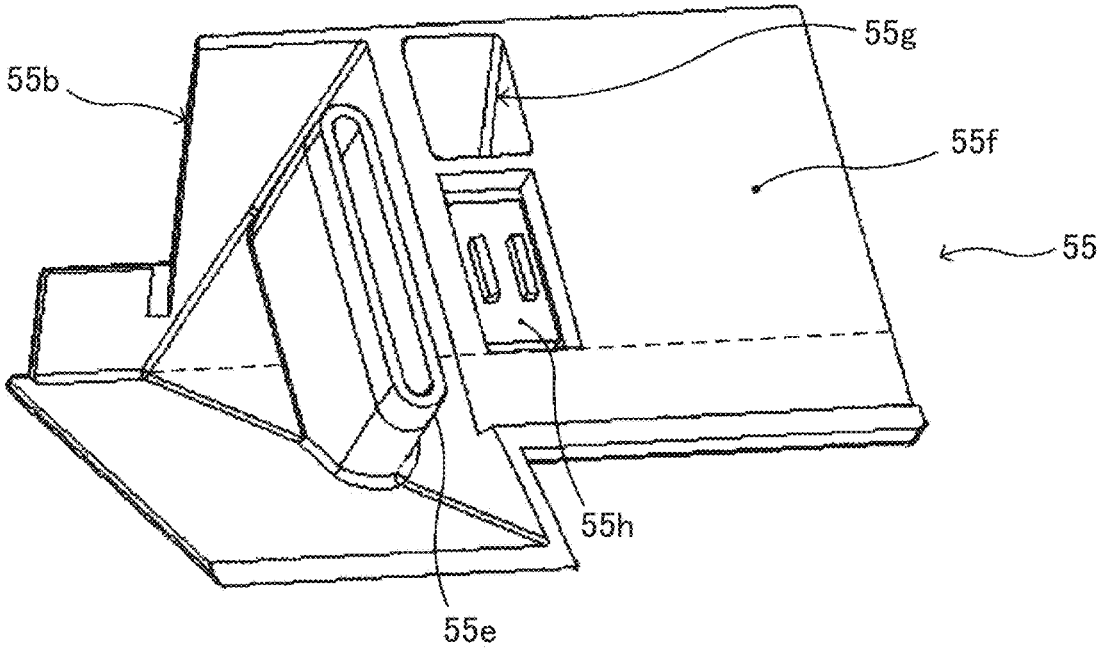
FIG. 12 is a perspective view illustrating the guide viewed from another angle.
Figure 13:
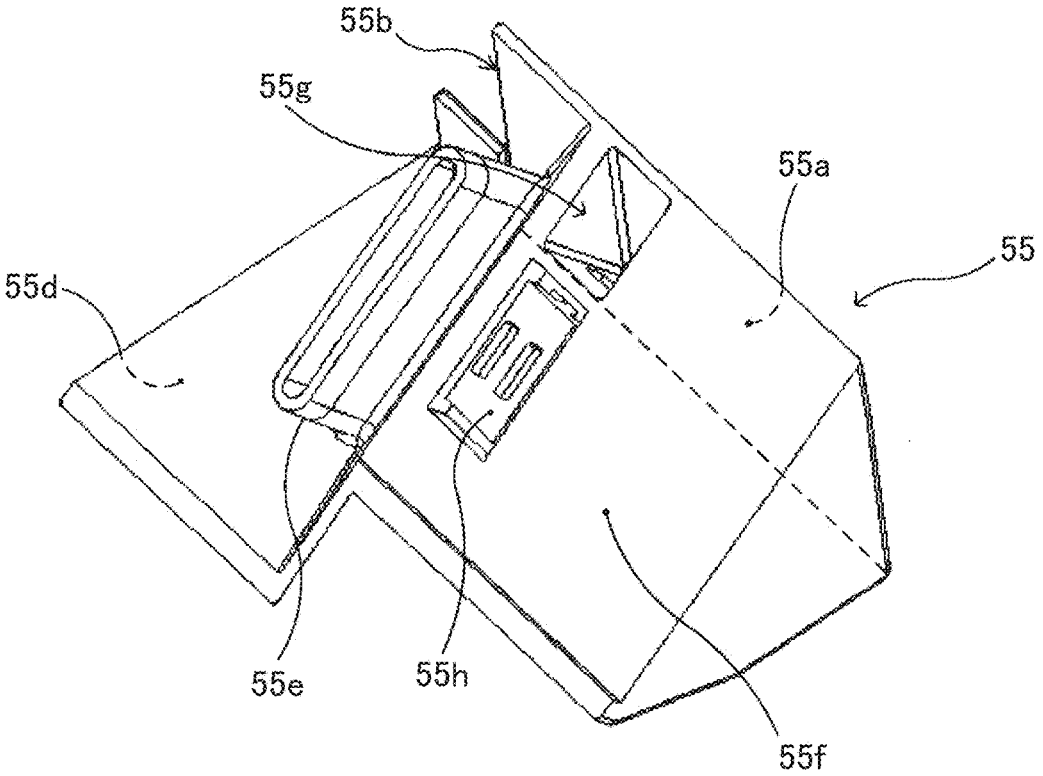
FIG. 13 is a perspective view illustrating the guide viewed from yet another angle.

For example, the guide 55 illustrated in FIGS. 10 to 13 is used. FIG. 10 is a schematic perspective view illustrating the front-end portion of the sheet feeding device 200 employing the guide 55 according to an example of this disclosure. FIG. 11 is an enlarged view illustrating the front-end portion of the sheet feeding device 200 of FIG. 10. FIG. 12 is a perspective view illustrating the guide 55, viewed from another angle from FIG. 11. FIG. 13 is a perspective view illustrating the guide 55, viewed from yet another angle from FIG. 12.

The guide 55 is detachably attached on the inclined plate portion 50*a* of the front-alignment fence 50 on the right side of the center reference line C when viewed from the upstream side of the sheet conveying direction, as illustrated in FIG. 10. As illustrated in FIG. 11, the guide 55 has a front wall 55*a* and an oblique ceiling plate 55*d*. A notch 55*b* is formed at the lower left of the front wall 55*a*. One sheet blocking portion on the right side of the pair of sheet blocking portions 50*b* is formed on the upper end of the front-alignment fence 50 in the notch 55*b*. The front wall 55*a* above the notch 55*b* functions as a blocker to cover the right-side opening of the pair of downward air suction nozzles 25*a* in FIG. 11. An upper end face 55*c* of the front wall 55*a* is a guide face facing the lower face of the attraction belt 21.

The oblique ceiling plate 55*d* of the guide 55 functions as a blocker to cover the floating nozzle 26*a* on the right side of the center reference line C to block air from the floating nozzle 26*a*. An inserting projection 55*e* that is inserted into the opening of the floating nozzle 26*a* is formed on the lower face side of the oblique ceiling plate 55*d*, as illustrated in FIGS. 12 and 13. Furthermore, as illustrated in FIGS. 12 and 13, the guide 55 includes a bottom plate 55*f*. The bottom plate 55*f* has a hole 55*g*, and a magnet 55*h* to be attracted to the inclined plate portion 50*a* made of metal.

The guide 55 is positioned by inserting the inserting projection 55*e* into the opening of the floating nozzle 26*a* of the inclined plate portion 50*a* on the right side of the center reference line C, and is attached by attracting the guide 55 to the inclined plate portion 50*a* made of metal by a magnetic force of the magnet 55*h* provided on the bottom plate 55*f*. In the state in which the guide 55 is attached to the inclined plate portion 50*a*, the guide 55 is positioned as illustrated in FIGS. 9D, 9E, and 9F. Thus, the upper end face 55*c* of the front wall 55*a* functions as a guide face, and supports the flap P1*a* to prevent the flap P1*a* from lowering. At the same time, the fold is strengthened while the folding line on the upstream side of the sheet conveying direction is being rubbed sequentially from the start point P1*b* of the flap P1*a* between the upper end face 55*c* of the front wall 55*a* and the lower face of the attraction belt 21*c*.

The guide 55 in this example is attached by the magnetic force of the magnet 55*h* and is removed against the magnetic force. Therefore, in a case in which an envelope in a flap folding state which is likely to be jammed by the lowering of the flap P1*a* is fed, the guide 55 is attached onto the inclined plate portion 50*a*. By contrast, in a case in which an envelope in the flap folding state is not fed, the guide 55 is removed from the inclined plate portion 50*a*. If the guide 55 is attached to the inclined plate portion 50*a* when feeding plain sheets or other general sheets, forming the space 51 such as the anti-curling, which is the original aim, is not achieved, and therefore, attaching or removing the guide 55 relative to the inclined plate portion 50*a* is to prevent jam from causing due to the contact of the curled portion with the guide 55 in some cases.

Furthermore, as illustrated in FIG. 11, in the guide 55 in this example, the air from the one floating nozzle 26*a* is less likely to reach the flap P1*a* by the oblique ceiling plate 55*d* or the inserting projection 55*e*, and the opening of one downward air suction nozzle 25*a* is covered with the front wall 55*a* so that air suction is less likely to reach the flap P1*a*. Furthermore, the separation air from one of the separation nozzles 26*b* is also less likely to reach the flap P1*a*. As a result, the lowering of the flap P1*a* due to the air flow is restrained.

Figure 14:
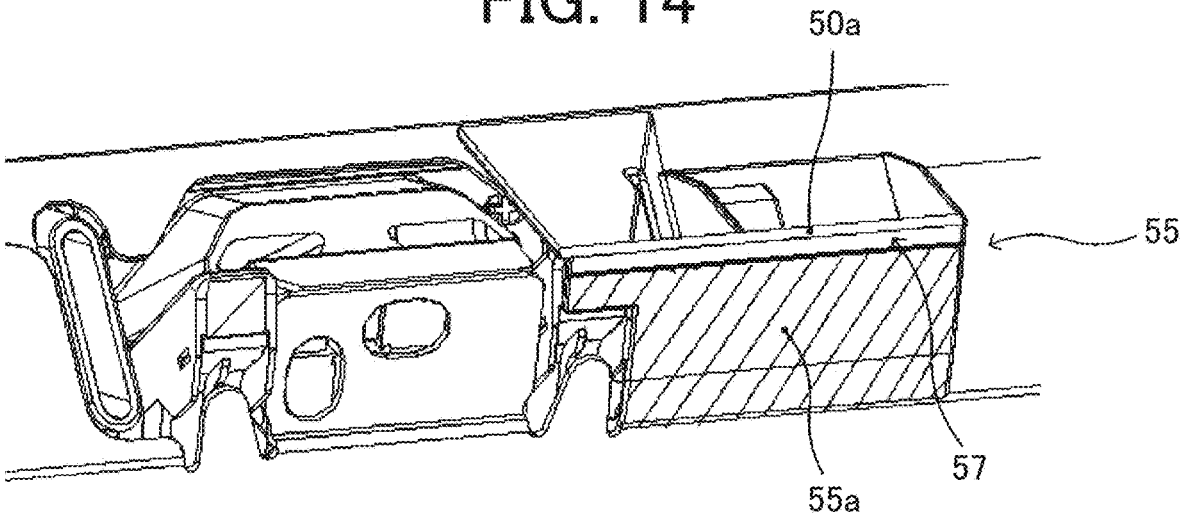
FIG. 14 is a perspective view illustrating a guide modified as a variation.

The guide 55 may be modified, as a variation, by removing the hatched portion of the front plate in FIG. 14. Since the function of the guide face of the guide 55 is exerted by the upper end face 55*c* of the front wall 55*a*, the function of the guide face is exhibited even when the upper portion 57 alone is provided by removing the hatched portion. Although the air flow control function degrades, for example, the opening of the downward air suction nozzle 25*a* is closed, this function is not provided if this function is not expected. While the rod-like member corresponding to the upper portion 57 may be provided alone, and the upper face of this rod-like member may be a guide face.

In the above example, the loading posture is for loading an envelope on the sheet loading table 11 in which the folding line of the flap P1*a* is located on the right side of the center reference line C. However, when the sheet is loaded on the sheet loading table 11 and fed such that the posture is rotated by 180 degrees and the folding line of the flap P1*a* is located on the left side of the center reference line C, a plurality of guides 55 is detachably attached at positions different from each other, in other words, at two or more positions set to be symmetrical on both the right and left sides with respect to the center reference line C (a center reference position) in accordance with the position of the flap P1*a*.

Figure 15:
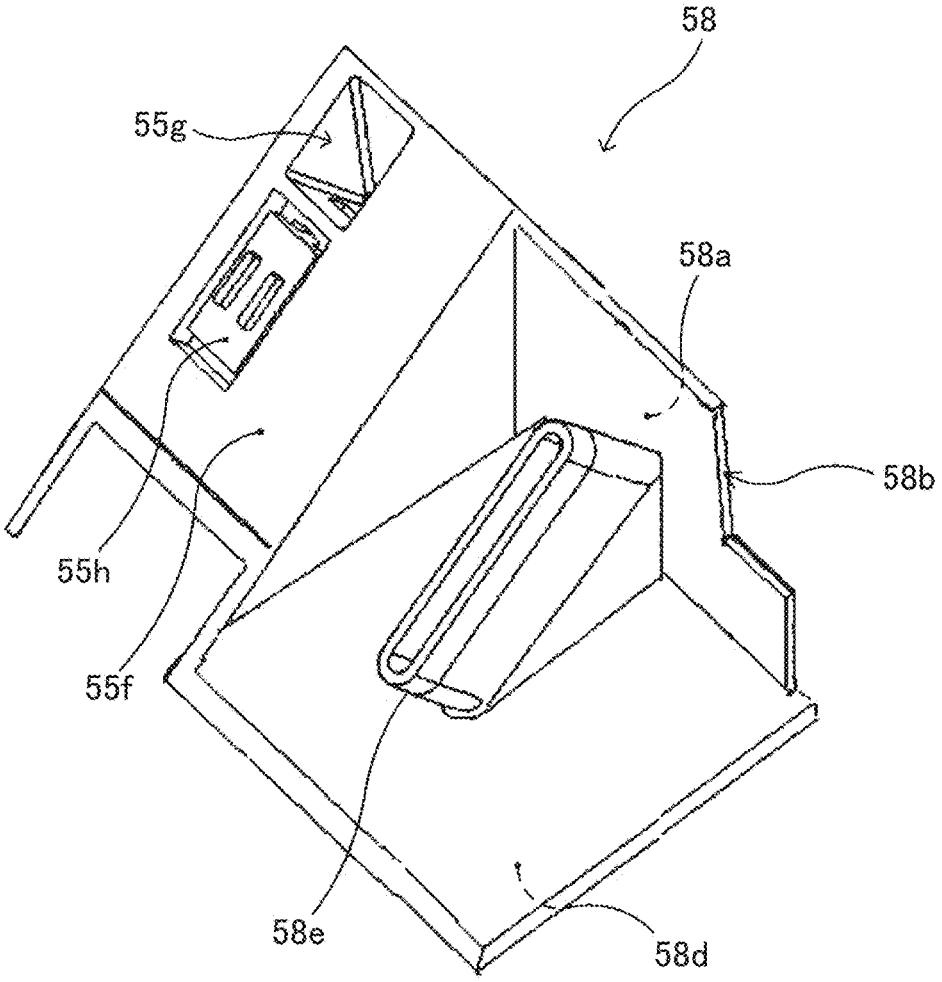
FIG. 15 is a perspective view of a guide modified as yet another variation.

Thus, the plurality of guides 55 may be prepared to be symmetrical, and the plurality of guides 55 alone may be attached, and may remain attached on both of the right and left sides as long as no inconvenience occurs. Moreover, the plurality of guides 55 symmetrical on the right and left sides may be connected to each other as a single unit. In a case in which both the plurality of guides 55 symmetrical on the right and left sides are attached, a guide 58 may be symmetrical to the guide 55 in FIG. 13, as illustrated in FIG. 15, as yet another variation. The guide 58 illustrated in FIG. 15 includes the bottom plate 55*f*, an oblique ceiling plate 58*d*, an inserting projection 58*e*, and a front plate 58*a*. The front plate 58*a* has a notch 58*b*, and the bottom plate 55*f* has the magnet 55*h*. As being obvious from the comparison with the guide 55 illustrated in FIG. 13, the position of the oblique ceiling plate 58*d* with respect to the bottom plate 55*f* and the position of the notch 58*b* in the front plate 58*a* are opposite to these positions of the guide 55 illustrated in FIG. 13.

Figure 16:
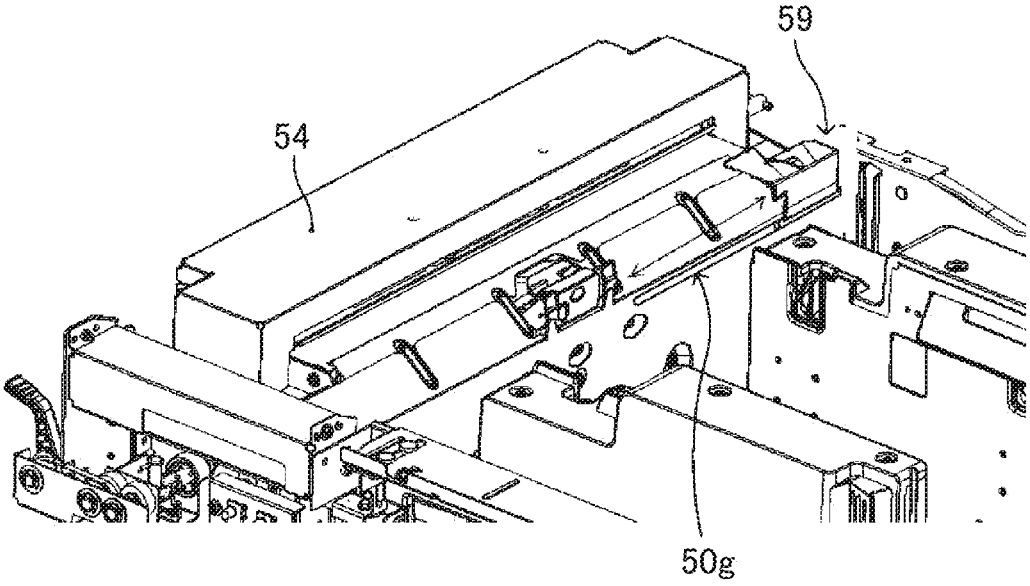
FIG. 16 is a perspective view illustrating a guide modified as yet another variation.

Instead of removing the guide 55 so as not to get in the way when feeding a general sheet, the guide may be changed between a state in which the upper face of the guide 55 faces the flap P1*a* in the part in the width of the sheet conveyance passage and a state in which the upper face of the guide 55 does not face the flap P1*a* in the part in the width of the sheet conveyance passage. The shape of the guide may be deformed or, as illustrated in FIG. 16, the guide 55 may be changed along movement in the direction of the width of the guide 55 (i.e., in the width direction of the guide 55). That is, as yet another variation, a guide 59 in FIG. 16 has a slide hole 50*g* formed in the upper portion of the front-alignment fence 50, and a portion to be guided that is guided entering into the slide hole 50*g*.

Figure 17:
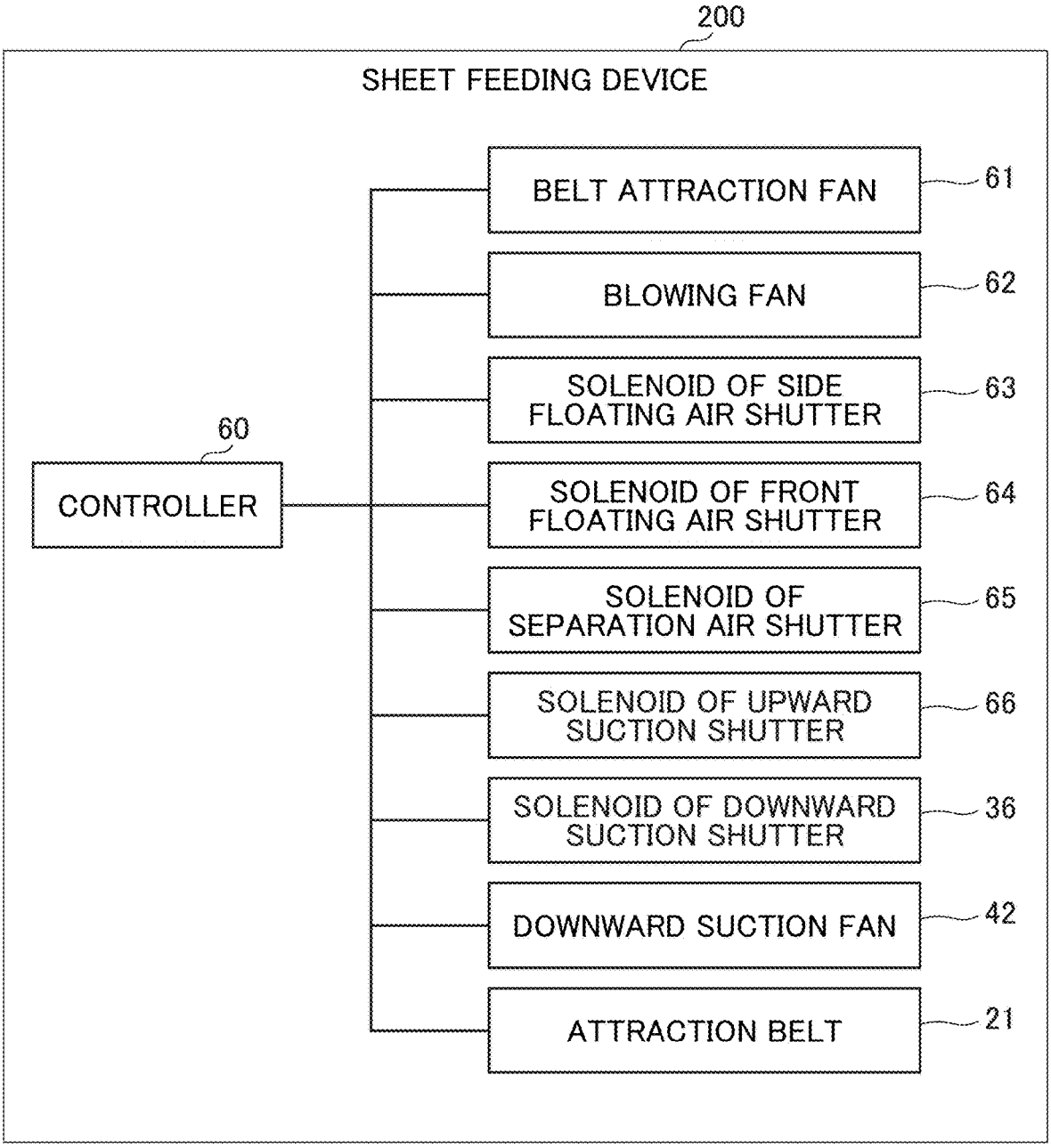
FIG. 17 is a block diagram illustrating an example of a main configuration of a control system in the sheet feeding device according to the present embodiment.

FIG. 17 is a block diagram illustrating an example of a main configuration of a control system in the sheet feeding device 200 according to the present embodiment.

As illustrated in FIG. 17, the controller 60 as control circuitry of the sheet feeding device 200 is connected to a belt attraction fan 61 that generates a negative pressure to attract a sheet to the attraction belt 21, a blowing fan 62 that blows air toward each of the front air blowing device 26 and the side air blowing devices 27, a solenoid 63 that operates a side floating air shutter, a solenoid 64 that operates a front floating air shutter, a solenoid 65 that operates a separation air shutter, a solenoid 66 that operates an upward suction shutter, a solenoid 36 that operates a downward suction shutter, the downward air suction fan 42 of the downward air suction device 25 that sucks air in the vicinity of the upper portion of the sheet bundle P, and the attraction belt 21.

Figure 18:
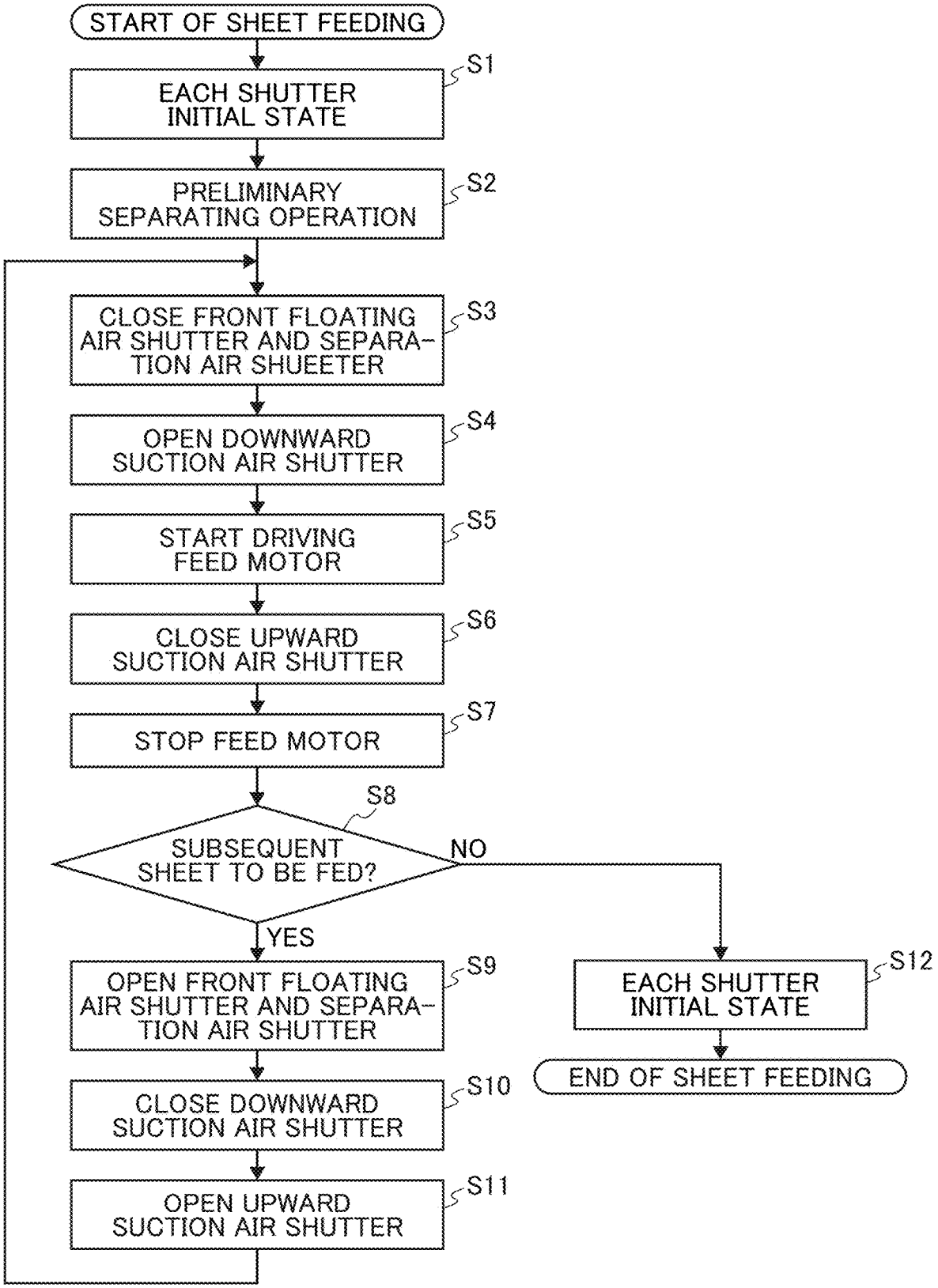
FIG. 18 is a flowchart of an example of a sheet feeding operation performed in the sheet feeding device according to the present embodiment.

FIG. 18 is a flowchart of an example of a sheet feeding operation performed in the sheet feeding device 200 according to the present embodiment.

A host controller of the image forming apparatus 100 receives an image forming instruction associated with the sheets set in the sheet trays 10 of the sheet feeding device 200 via a control panel of the image forming apparatus 100. Then, the host controller transmits a feeding instruction and information, such as the type of the sheet loaded on the sheet loading table 11 of the sheet trays 10, to the controller 60 of the sheet feeding device 200 (see FIG. 11). On receipt of the feeding instruction, the controller 60 checks whether each of the side floating air shutter, the front floating air shutter, the separation air shutter, the upward suction air shutter, and the downward suction air shutter is in the initial state while the attraction belt 21 is stopped. If there is any shutter not in the initial state, the controller 60 sets the shutter to the initial state (step S1). The initial state of each of the side floating air shutter, the front floating air shutter, the separation air shutter, and the upward suction air shutter is "open (in an open state)", while the initial state of the downward suction air shutter is "closed (in a closed state)". As described below, since the shutter is initialized and the feeding operation is terminated, each shutter is normally in the initial state at the start of the feeding operation.

Next, the controller 60 causes the blowing fans of the side floating air, the front floating air, and the separation air, the belt attraction fan of the upward suction air, and the downward suction fan of the downward suction air to operate. Then, the controller 60 executes a preliminary separating operation for 5 seconds (step S2). In the present embodiment, the preliminary separating operation is executed for 5 seconds. It is to be noted that the time of the preliminary separating operation is not limited to 5 seconds and may be appropriately set according to the configuration of the sheet feeding device.

During the preliminary separating operation, the side floating air shutter and the front floating air shutter are opened. Accordingly, the side floating air and the front floating air are blown to the lateral sides and the front side of the upper portion of the sheet bundle P. Thus, the first sheet being the uppermost sheet and several sheets of the second and subsequent sheets float among sheets in the upper portion of the sheet bundle P. In the preliminary separating operation, since the separation air shutter is also opened, the first sheet is separated from the second and subsequent sheets by the separation air. Further, in the preliminary separating operation, the upward suction air shutter is also opened, thus causing the floated first sheet to be attracted to the attraction belt 21.

When the preliminary separating operation is terminated (after 5 seconds have passed from the start of the operation of each fan), the attraction belt 21 is rotated to feed the first sheet. At this time, if the second sheet excessively floats or disturbs the behavior and contacts the first sheet, the second sheet might be conveyed from the sheet bundle P together with the first sheet. Hence, when the preliminary separating operation is completed, the front floating air shutter and the separation air shutter are closed to drop the floated second sheet so as not to contact the first sheet, thus restraining the multifeeding (step S3). Further, the downward suction air shutter is opened to start downward suction (step S4). The downward suction air shutter is closed until the preliminary separating operation is completed. Thus, in the preliminary separating operation, the first sheet is favorably attracted to the attraction belt 21 without being disturbed by the downward suction air. Then, a feed motor is started to rotate the attraction belt 21 on which the first sheet is attracted, thus starting sheet feeding (step S5).

When a predetermined time has passed from the start of feeding (when the leading end of the first sheet is fed to a predetermined subsequent step (for example, a pair of conveying rollers) downstream from the attraction belt 21, the upward suction air shutter is closed to release the first sheet attracted on the attraction belt 21 (step S6). Further, driving of the feeding motor is stopped to stop the attraction belt 21 (step S7).

Next, the controller 60 determines whether there is a sheet to be fed (step S8). When there is a subsequent sheet to be fed (YES in step S8), the controller 60 causes the front floating air shutter to open to resume the blowing of the front floating air toward the front side of the upper portion of the sheet bundle P. The controller 60 also causes the separation air shutter to open and resumes the blowing of the separation air (step S9).

Next, the controller 60 closes the downward suction air shutter and prevents the floating of the second sheet to be fed subsequently from being disturbed by the downward suction air (step S10). The controller 60 opens the upward suction fan shutter to resume the attraction of the sheet to the attraction belt 21 (step S11). Thus, the second sheet can be favorably attracted to the attraction belt. Then, the process from steps S3 to S8 is performed to feed the sheet.

In step S8, steps S3 to S11 are repeated until the number of sheets fed reaches a set number. If the number of sheets fed reaches the set number and there is no subsequent sheet to be fed (NO in step S8), the controller 60 causes, in step S12, each shutter to be set in the initial state, stops the operation of each fan, and terminates the feeding operation.

Figure 19:
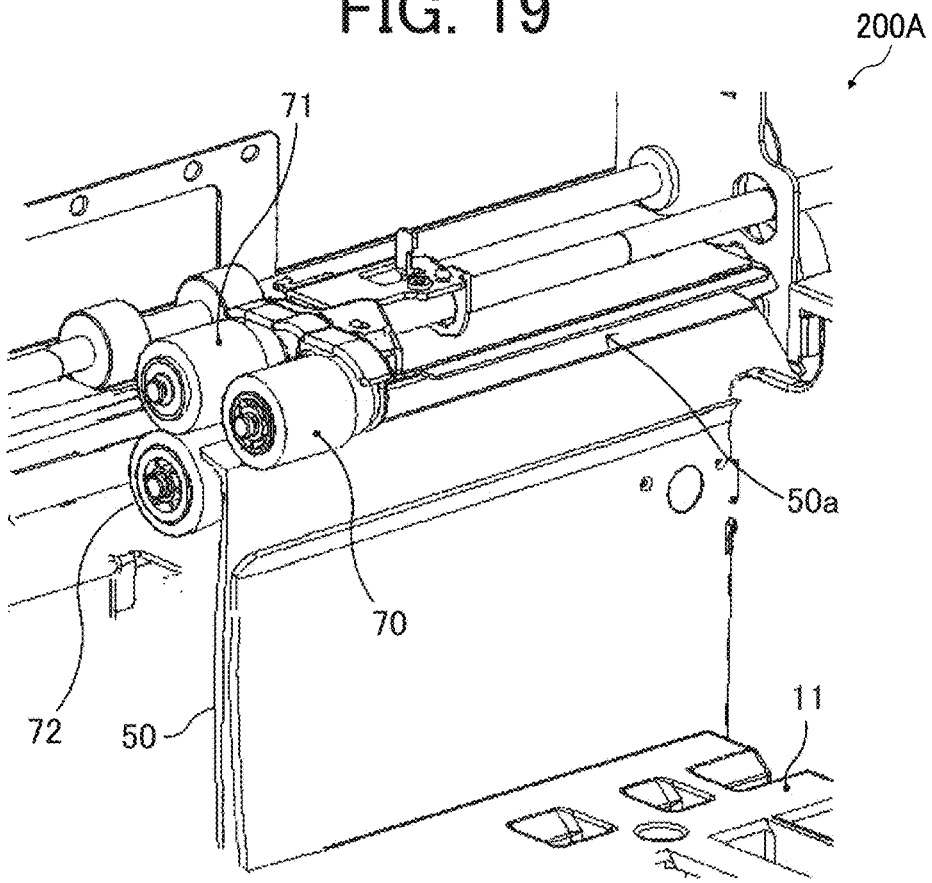
FIG. 19 is a perspective view illustrating a schematic configuration of a sheet feeding device according to another embodiment of this disclosure.
Figure 20:
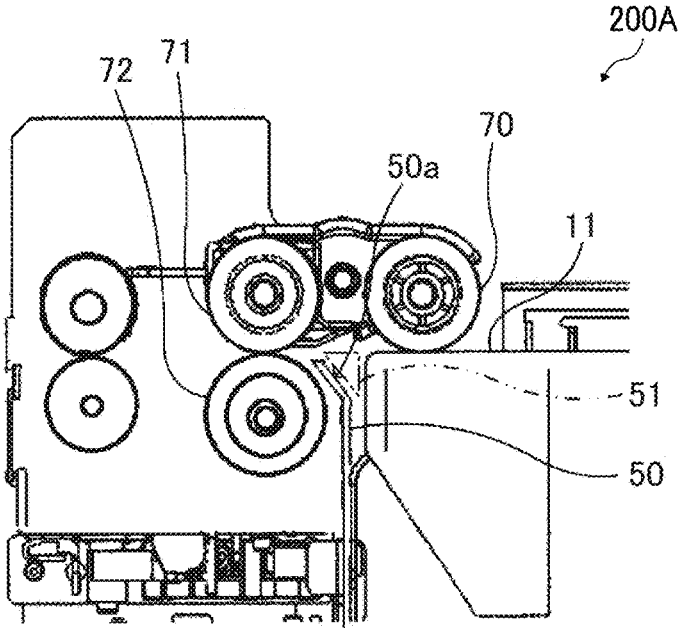
FIG. 20 is a schematic side view illustrating the sheet feeding device of FIG. 19.

The sheet feeding device 200 in the above embodiment uses the attraction belt 21 and the air blowing device 24 as illustrated in FIG. 3. However, instead of this configuration, another sheet feeding device of other methods, for example, the mechanical belt method or the roller method is also applicable to this disclosure. FIGS. 19 and 20 illustrate a sheet feeding device 200A that employs of an FRR method having a pick-up roller 70 as a first conveyor, and a feed roller 71 as a second conveyor disposed adjacent to the pick-up roller 70, in which a reverse roller 72 for separation is in contact with the feed roller 71 from below. The basic functions (except for the air-related functions) such as the sheet loading table 11, the pair of side fences 28, and the end fence 29 of the sheet feeding device 200A are the same as the basic functions of the sheet feeding device 200 according to the above-described embodiment. FIG. 19 is a perspective view illustrating a schematic configuration of the sheet feeding device 200A according to another embodiment of this disclosure. FIG. 20 is a schematic side view illustrating the sheet feeding device 200A of FIG. 19.

As illustrated in FIG. 20, the inclined plate portion 50*a* is provided at the upper end of the front-alignment fence 50, and the space 51 is formed between (defined by) the inclined plate portion 50*a* and the sheet conveyance passage. The leading end of the second and subsequent sheets drawn by the uppermost sheet drawn by the pick-up roller 70 in the sheet bundle P loaded on the sheet loading table 11 contacts the inclined plate portion 50*a* to be preliminary separated. The sheet feeding device 200A also performs the anti-curling function. The space 51 is generated between the upper face of the inclined plate portion 50*a* as described above and the sheet conveyance passage.

Figure 21:
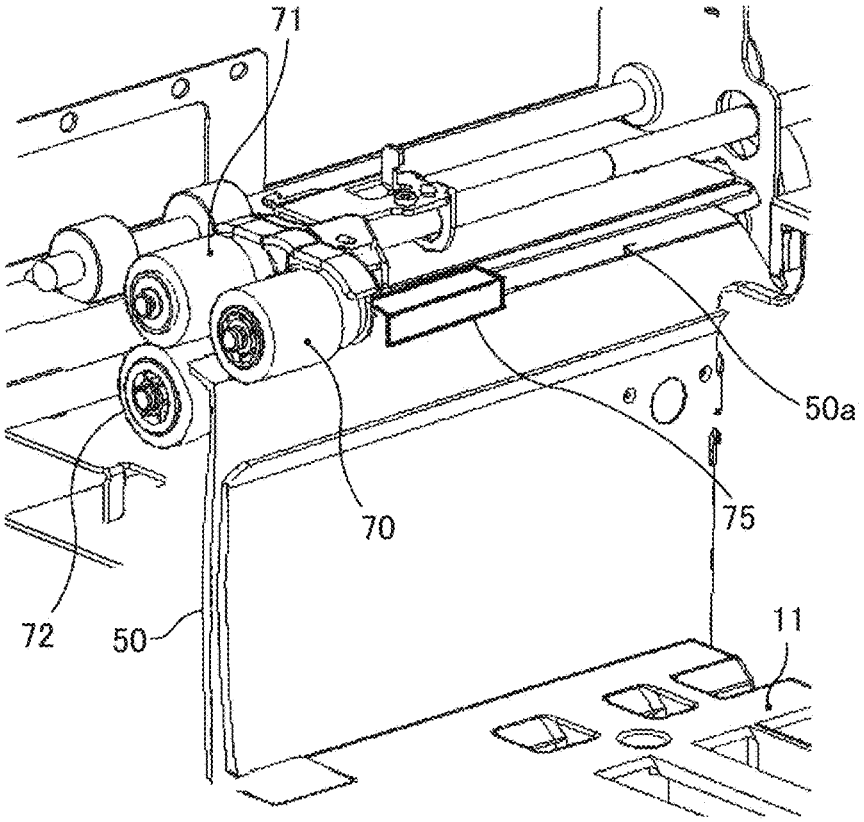
FIG. 21 is a perspective view illustrating a schematic configuration of the sheet feeding device in a state in which a guide is attached.
Figure 22:
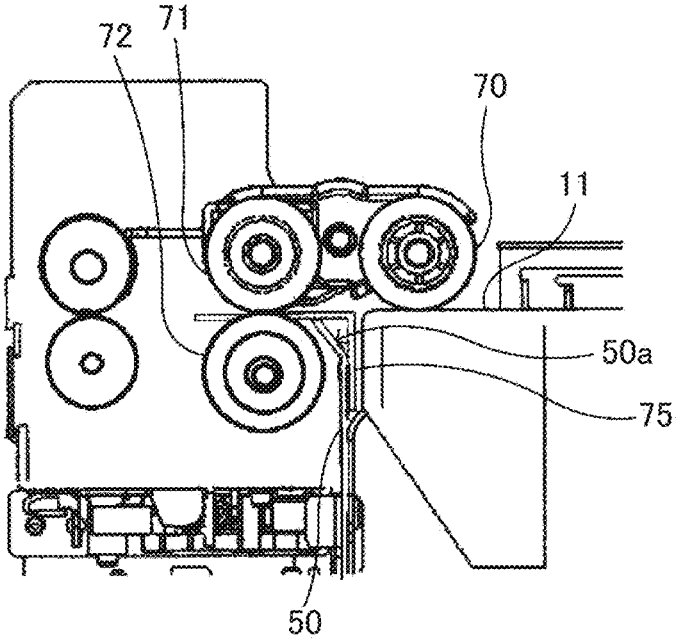
FIG. 22 is a schematic side view illustrating the sheet feeding device in the same state as FIG. 21.

Since the space 51 is generated between the upper face of the inclined plate portion 50*a* and the sheet conveyance passage, as similar to the sheet feeding device 200 of the above-described embodiment, when the sheet is fed while being loaded on the sheet loading table 11 in a posture in which the flap P1*a* of the envelope P1 is folded, in which the folding line direction is parallel to the sheet conveying direction, and in which the flap P1*a* is in the lower side, the flap P1*a* may lower in the space 51 to contact with the inclined plate portion 50*a* to cause jam. Therefore, in order to address this inconvenience, as illustrated in FIGS. 21 and 22, a guide 75 having an upper face facing a part of the width of the sheet conveyance passage located above the space 51 is provided. FIG. 21 is a perspective view illustrating a schematic configuration of the sheet feeding device 200A in a state in which the guide 75 is attached. FIG. 22 is a schematic side view illustrating the sheet feeding device 200A in the same state as FIG. 21.

Figure 23:
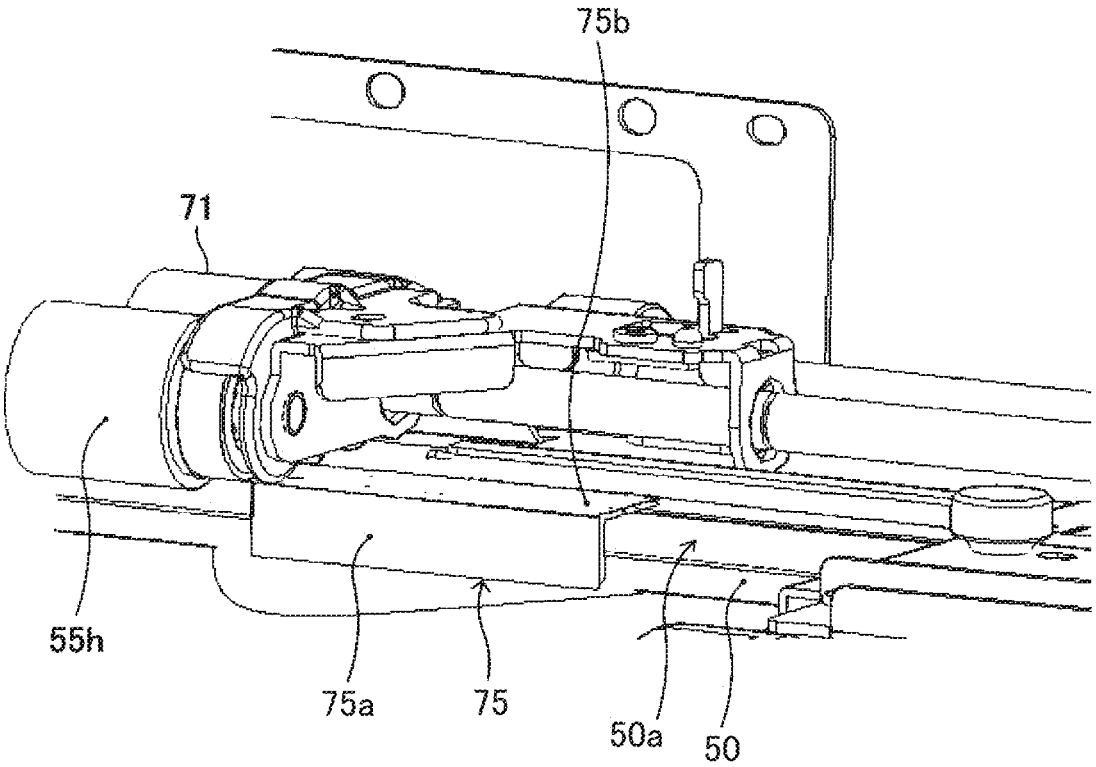
FIG. 23 is an enlarged perspective view illustrating the sheet feeding device.

FIG. 23 is an enlarged perspective view illustrating the sheet feeding device 200A.

As illustrated in FIG. 23, the guide 75 includes a front plate 75*a* and a ceiling plate 75*b* extending from the upper end of the front plate 75*a* to the downstream side of the sheet conveying direction. The upper face of the ceiling plate 75*b* functions as a guide face. The guide 75 is also detachably attached to the front-alignment fence 50 made of metal and the inclined plate portion 50*a* by a magnetic by the magnetic force.

The guide 75 illustrated in FIGS. 21, 22, and 23 has the ceiling plate 75*b* extending from the front plate 75*a* to the downstream side of the sheet conveying direction. However, the ceiling plate 75*b* may be removed, and the upper end face of the front plate 75*a* may form the guide face. Furthermore, a member may be added to face the guide 75 and sandwich the flap P1*a* to strengthen the fold.

It is to be noted that, in the above-described embodiments and variations, the method of detaching and attaching the guide 55 and other members may be performed by mechanical engagement, for example, screwing, in addition to using magnetic force. The material of the guide 55 is not particularly limited to the above-described embodiments and variations. For example, the guide 55 may be made of metal or resin.

Further, although the above-described embodiments and variations describe that this disclosure is applied to the image forming system 1 including the image forming apparatus 100 and the sheet feeding device 200 but this disclosure is not limited thereto. For example, this disclosure may be applied to a sheet feeding device (for example, the sheet feeding device 200) provided in the image forming apparatus 100.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A sheet feeding device comprising:

a sheet loader configured to load a sheet bundle including a sheet with a flap;

a first conveyor configured to convey the sheet with the flap loaded on the sheet loader;

an aligner configured to align an end of the sheet bundle loaded on the sheet loader;

a second conveyor disposed adjacent to the first conveyor along a sheet conveyance passage; and a guide disposed along the sheet conveyance passage between the sheet loader and the second conveyer such that the guide covers a portion, in a width direction of the sheet conveyance passage, of a space between a lower face of the first conveyer and an inclined plate portion of the aligner to guide a lower face of the flap of the sheet across the space, the inclined plate portion of the aligner including at least one floating nozzle therein to direct floating air blown by an air blower to float an uppermost sheet of the sheet bundle on the sheet loader.

2. The sheet feeding device according to claim 1, further comprising:

an opposing body disposed facing the guide from above.

3. The sheet feeding device according to claim 2, wherein the opposing body is a sheet conveying body of the first conveyor.

4. The sheet feeding device according to claim 1, wherein the guide is detachably attached to the sheet feeding device.

5. The sheet feeding device according to claim 4, further comprising:

a plurality of guides including the guide, wherein the plurality of guides is detachably attached at two or more positions different from each other.

6. The sheet feeding device according to claim 5, wherein the two or more positions are symmetrical on both sides with respect to a center reference position.

7. The sheet feeding device according to claim 1, wherein the guide is configured to change between a first state in which the guide faces the flap from below and a second state in which the guide does not face the flap.

8. The sheet feeding device according to claim 7, wherein the guide is configured to change between the first state and the second state along with movement in a width direction of the guide.

9. The sheet feeding device according to claim 1, wherein the first conveyor includes:

the air blower configured to blow the floating air from a plurality of the at least one floating nozzle to float the uppermost sheet of the sheet bundle on the sheet loader; and a sheet conveying body configured to convey the uppermost sheet floated by the air blower, and wherein the guide includes a blocker configured to block the floating air blown by the air blower in a width direction of the guide.

10. The sheet feeding device according claim 9, wherein the first conveyor includes an air sucker configured to suck downward air from a plurality of portions to generate a downward force to the sheet near the uppermost sheet of the sheet bundle that is floating, and wherein the guide includes another blocker configured to block the downward air sucked by the air sucker in the width direction of the guide.

11. An image forming apparatus comprising:

an image forming device configured to form an image on a sheet; and the sheet feeding device according to claim 1, configured to feed the sheet toward the image forming device.

12. An image forming system comprising:

an image forming apparatus including an image forming device configured to form an image on a sheet; and the sheet feeding device according to claim 1, configured to feed the sheet toward the image forming apparatus.

13. The sheet feeding device according to claim 1, wherein at least one or more of a downward air suction nozzle, a sensor holder, and a sensor cover plate extend into the space, and the guide is configured to inhibit the flap from contacting the one or more of the downward air suction nozzle, the sensor holder, and the sensor cover plate extending into the space.

14. The sheet feeding device according claim 1, wherein the guide includes a blocker configured to block the floating air blown by the air blower in a width direction of the guide.

15. A sheet feeding device comprising:

a sheet loader configured to load a sheet bundle including a sheet with a flap;

a first conveyor configured to convey the sheet with the flap loaded on the sheet loader;

a second conveyor disposed adjacent to the first conveyor; and a guide disposed below the flap of the sheet to be conveyed, between the second conveyor and the sheet loader in a sheet conveying direction of the sheet, the guide configured to guide the sheet, the guide including a blocker configured to block floating air blown by an air blower in a width direction of the guide.

16. An image forming apparatus comprising:

an image forming device configured to form an image on a sheet; and the sheet feeding device according to claim 15, configured to feed the sheet toward the image forming device.

17. An image forming system comprising:

an image forming apparatus including an image forming device configured to form an image on a sheet; and the sheet feeding device according to claim 15, configured to feed the sheet toward the image forming apparatus.

18. A sheet feeding device comprising:

a sheet loader configured to load a sheet bundle including a sheet with a flap;

a first conveyor configured to convey the sheet with the flap loaded on the sheet loader;

an aligner configured to align an end of the sheet bundle loaded on the sheet loader;

a second conveyor disposed adjacent to the first conveyor along a sheet conveyance passage; and a guide disposed along the sheet conveyance passage between the sheet loader and the second conveyer such that the guide covers a portion, in a width direction of the sheet conveyance passage, of a space between a lower face of the first conveyer and an inclined plate portion of the aligner to guide a lower face of the flap of the sheet across the space, wherein at least one or more of a downward air suction nozzle, a sensor holder, and a sensor cover plate extend into the space, and the guide is configured to inhibit the flap from contacting the one or more of the downward air suction nozzle, the sensor holder, and the sensor cover plate extending into the space.

* * * * *